US007177384B2

(12) United States Patent
Murakami et al.

(10) Patent No.: US 7,177,384 B2
(45) Date of Patent: Feb. 13, 2007

(54) ALUMINUM COMPOSITE MATERIAL, MANUFACTURING METHOD THEREFOR, AND BASKET AND CASK USING THE SAME

(75) Inventors: Kazuo Murakami, Hyogo (JP); Tomikane Saida, Hyogo (JP); Yasuhiro Sakaguchi, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 23 days.

(21) Appl. No.: 10/389,779

(22) Filed: Mar. 18, 2003

(65) Prior Publication Data

US 2003/0179846 A1 Sep. 25, 2003

Related U.S. Application Data

(62) Division of application No. 09/657,907, filed on Sep. 8, 2000, now abandoned.

(30) Foreign Application Priority Data

Sep. 9, 1999 (JP) ..... 11-256407

(51) Int. Cl.
*G21C 19/00* (2006.01)

(52) U.S. Cl. ..... 376/272; 250/506.1; 420/528; 75/252

(58) Field of Classification Search ..... 376/272; 250/506.1, 507.1; 420/528; 75/252, 351, 75/249, 244, 232
See application file for complete search history.

(56) References Cited

U.S. PATENT DOCUMENTS 3,397,044 A * 8/1968 Bylund ..... 428/583
3,785,807 A * 1/1974 Backerud ..... 420/552
4,292,528 A 9/1981 Shaffer et al.
4,503,021 A * 3/1985 Brynestad et al. ..... 423/297
4,806,307 A * 2/1989 Hirose et al. ..... 420/528
4,827,139 A * 5/1989 Wells et al. ..... 250/507.1
4,916,030 A * 4/1990 Christodoulou et al. .... 428/614
4,973,522 A 11/1990 Jordan et al.
5,405,578 A * 4/1995 Setzer et al. ..... 420/590
5,415,708 A 5/1995 Young et al.
5,486,223 A 1/1996 Carden
5,700,962 A 12/1997 Carden
5,715,289 A * 2/1998 Kirchner et al. ..... 376/272
5,898,747 A 4/1999 Singh
6,044,897 A * 4/2000 Cross ..... 164/473
6,217,632 B1 * 4/2001 Megy ..... 75/680
6,252,923 B1 6/2001 Iacovino et al.
6,602,314 B1 8/2003 Sakaguchi et al.
6,605,817 B1 8/2003 Nihei et al.

FOREIGN PATENT DOCUMENTS

CA EP 0 396 388 * 7/1990

(Continued)

*Primary Examiner*—R. J. Palabrica
(74) *Attorney, Agent, or Firm*—Oblon, Spivak, McClelland, Maier & Neustadt, P.C.

(57) ABSTRACT

A basket has a lattice-like section for accommodating individual used nuclear fuel in predetermined positions in a cask. The basket is made from aluminum composite material having good neutron absorption ability, excellent mechanical property and workability. The aluminum composite material is made by having, in an Al or Al alloy base phase, B or B compound with a neutron absorption ability and an additive element, e.g. Zr or Ti, for giving a high strength property, and subjecting to a sintering under pressure.

18 Claims, 12 Drawing Sheets

FOREIGN PATENT DOCUMENTS

| | | | |
|---|---|---|---|
| DE | 43 08 612 | | 9/1994 |
| DE | 43 08 612 | C2 | 9/1994 |
| GB | EP0396388 | A2 | 11/1990 |
| JP | 53-057399 | | 5/1978 |
| JP | 53-57399 | | 5/1978 |
| JP | 59-6339 | | 1/1984 |
| JP | 59-008339 | | 1/1984 |
| JP | 59-501672 | | 10/1984 |
| JP | 60-096746 | | 5/1985 |
| JP | 61-235523 | | 10/1986 |
| JP | 62-070799 | | 4/1987 |
| JP | 62-235437 | | 10/1987 |
| JP | 62-238066 | | 10/1987 |
| JP | 62-243733 | | 10/1987 |
| JP | 62-282644 | | 12/1987 |
| JP | 63-157831 | | 6/1988 |
| JP | 63-159794 | | 7/1988 |
| JP | 63-312943 | | 12/1988 |
| JP | 01-242749 | | 9/1989 |
| JP | 01-268838 | | 10/1989 |
| JP | 1-312043 | | 12/1989 |
| JP | 1-312044 | | 12/1989 |
| JP | 61-203398 | | 12/1989 |
| JP | 03-281748 | | 12/1991 |
| JP | 04-236701 | | 8/1992 |
| JP | 06-057363 | | 3/1994 |
| JP | 06-094892 | | 4/1994 |
| JP | 09-159796 | | 6/1997 |
| JP | 9-165637 | | 6/1997 |
| JP | 9-249930 | | 9/1997 |
| JP | 11-148377 | | 5/1999 |
| JP | 2001-042089 | | 2/2001 |
| NO | EP1029934 | A1 | 8/2000 |
| WO | WO 84/01390 | | 4/1984 |
| WO | WO 98/00258 | | 1/1998 |

* cited by examiner

ALUMINUM COMPOSITE MATERIAL, MANUFACTURING METHOD THEREFOR, AND BASKET AND CASK USING THE SAME

FIELD OF THE INVENTION

The present invention relates to an aluminum (Al) composite material having a neutron absorption ability and a manufacturing method therefor. Specifically, this invention relates to a basket, made from an aluminum compound material having a neutron absorption ability, accommodating a used nuclear fuel assembly. Further, this invention relates to a cask provided with the basket.

BACKGROUND OF THE INVENTION

Nuclear fuel assembly that has been combusted in a nuclear reactor for a prescribed duration, that is, the so-called used nuclear fuel assembly, is cooled for a predetermined period of time in a cooling pit of an atomic power plant. Further, the used nuclear fuel assembly is accommodated in a cask, which is a container for transportation, and transported to a storage and recycling facility, where they are stored. To accommodate used nuclear fuel assembly in the cask, there is employed a holding container having a lattice-like section (called "basket"), which has a plurality of accommodation chambers as cells for the used nuclear fuel assemblies to be inserted therein one by one, with ensured adequate holding forces such as against vibrations during transportation.

In the conventional basket, as shown in FIG. 16, longitudinal and transverse plate-like members 1 are alternately combined by engagement between slits 2 formed therein, to provide a lattice-like section for used nuclear fuel assemblies to be inserted therein. In an employed plate-like member 1, as a base material la there is an aluminum alloy 10 mm or near in thickness and having an excellent characteristic in strength, such as in Al—Cu alloys specified by JIS2219 or Al—Mg alloys specified by JIS5083, for example, and on a surface thereof is affixed a plate member (a nuclear absorbing material) 1 mm or near in thickness and made of Al—B alloy having a neutron absorption ability.

Such an affix structure is employed because the neutron absorbing material is low of workability and difficult to be solely used as a structural member. In general, the plate-like members 1 have a width ranging 300 to 350 mm or near.

However, the plate-like member 1 used in the conventional basket in which a neutron absorbing material 3 is affixed on the aluminum alloy base material la requires much time for manufacture and also the material is costly. By the way, affixation of the neutron absorbing material 3 to the base material is performed by spot welding, screw fastening, or riveting. Further, in general, a few thousands of plate-like members 1 are necessary for manufacture of baskets to be accommodated in a single cask.

Further, in the conventional plate-like member 1, there can develop a step between the base material la and the neutron absorbing material 3 affixed thereon. It is know from experience that, the used nuclear fuel assembly gets caught create problem during their insertion or removal. Moreover, in the case of affix by a spot welding, deterioration in a long-term use may cause the neutron absorbing material 3 to exfoliate, as another problem. Accordingly, it is desirable to solely use Al—B alloy having a neutron absorption ability to make the baskets.

Conventionally, dissolution methods are used for manufacture of an Al—B alloy. However, the liquid phase line temperature rises steeply as the quantity of added B (Boron) (hereafter, addition quantity of B) increases. Therefore, B is added as powder or in the form of Al—B alloy into the Al (Aluminum) alloy, or added in the form of a boron compound such as $KBF_4$ into molten Al to produce an Al—B inter-metal compound, or those by a casting from a solid-liquid coexisting region under the liquid phase line temperature, or by way of a casting under pressure, with various improvements for enhanced mechanical properties such as strength and ductility.

There are many such improvements, for example, Japanese Patent Application Laid-Open Publication Nos. 59-501672, 61-235523, 62-70799, 62-235437, 62-243733, 63-312943, 1-312043, 1-312044, 9-165637, etc.

In Al—B alloys manufactured using the dissolution methods, upon addition of B that absorbs neutrons, if there exist inter-metal compounds of $AlB_2$ and $AlB_{12}$ as B compounds, in particular if there exist much $AlB_{12}$, then the workability is reduced. However, it is difficult to control the quantity of $AlB_{12}$ from the currently available technology. As a consequence, 1.5 weight % is the limit as a quantity of B to be added as a practical material. However, with this amount, there is a drawback that the effect of neutron absorption is small.

Instead of Al—B alloys "Boral" may be used as the material for neutron absorption. Boral is a sandwiched and pressed material of powder having 30–40 weight percentage of $B_4C$ mixed in Al base material. However, the tensile strength of Boral is about 40 Mpa and thus it is very low, extension is about 1% and thus small, and further it is difficult to mold. As a consequence, the reality is that, Boral has not been used as structural material till present.

As another manufacturing method of Al—$B_4C$ composite material, there is use of a power sintering method, in which Al alloy and $B_4C$, both as powder, are uniformly mixed and solidified for formation, and which can avoid problems described in conjunction with dissolution, in addition to having merits such as the possibility of more flexible selection of matrix compound.

In U.S. Pat. No. 5,486,223 and a series of subsequent inventions by the same inventors, there are described methods of using a powder metallurgical method to obtain an Al—$B_4C$ composite material excellent in strength characteristic. In particular, U.S. Pat. No. 5,700,962 mainly addresses manufacture of a neutron shielding material.

In those inventions, however, there is employed a special $B_4C$ having a particular element added to enhance the binding with matrix, and the process also is complex, as problems significant in cost for practice in industrial scale. Further, there are anxieties in performance such that a porous formed body of powder simply hardened by CIP is heated and extruded, accompanying gas intrusion, and that some matrix composition is exposed to high temperatures over 625° C., when sintering a billet, with resultant significant deterioration of characteristic.

As described, Al alloys manufactured by dissolution method had a limit in quantity of addition of a compound having neutron absorption power, such as B, and the neutron absorption effect was small. For solution thereto, the above-noted many inventions were made, with prerequisites for practice, such as dissolution of a base alloy having controlled proportions to the extent of contained compound phases ($AlB_2$, $AlB_{12}$, etc.) as well, and use of a very expensive condensed boron, causing a great increase in production cost, with a difficulty of practice in industrial scale.

In regard of operation also, there were problems such as contamination in reactor (with the need of a reactor cleaning to remove dross of high B concentration, as contamination by stagnation such as of fluorides thrown in, etc.), and damages to reactor materials due to a high dissolution temperature (needing sometime 1200° C. or more), practically with the impossibility of execution in ordinary Al oriented dissolution facilities.

As to the Boral of which the $B_4C$ content is as high as 30–40 weight percentage, because of the problem of workability, the use as a structural material is impossible.

On such background, it has been desirable to implement an aluminum composite material that, by in crease in B content, has a high neutron absorption ability, as a matter of course, and excellent mechanical properties such as tensile strength and extension, and is easy of machining, to be applicable as a structural material with a neutron absorption ability, as well as a manufacturing method therefor.

SUMMARY OF THE INVENTION

It is an object of the present invention to provide an aluminum composite material and a manufacturing method therefor, allowing for an increased B content to have a raised neutron absorption ability, and also for addition of Zr or Ti to have an excellent mechanical property and workability.

It also is an object of the present invention to provide a basket that employs an aluminum composite material as a structural material excellent of neutron absorption ability, as well as in mechanical property and workability, and can be manufactured with an inexpensive cost, and a cask that is provided with such a basket.

In such a situation, the present inventors have established a method for inexpensive manufacture of an Al based composite material meeting necessary neutron shielding ability and strength characteristics in a well balanced manner by use of ordinary $B_4C$, which is inexpensively market-available as a polishing or refractory material, and by addition such as of Zr or Ti, and have found out an alloy composition ($B_4C$ addition quantity inclusive) for the method to exhibit a best effect.

As a solution to the object described, the present invention employs the following measures. That is, according to an aspect of the invention, there is provided an aluminum composite material containing, in an Al or Al alloy base phase, B or B compound having a neutron absorption ability and an additive element for giving a high strength property, and sintered under pressure.

In this aspect of the invention, the B or B compound may preferably range in content, in terms of a B quantity, 1.5 weight percentage or more and 9 weight percentage or less, and more preferably range in content, in terms of the B quantity, 2 weight percentage or more and 5 weight percentage or less. Further, the additive element for giving the high strength property may be Zr, and in this case, the Zr may preferably range 0.2 weight percentage or more and 2.0 weight percentage or less in content, and more preferably 0.5 weight percentage or more and 0.8 weight percentage or less. Alternately, the additive element for giving the high strength property may be Ti, and in this case, the Ti may preferably range 0.2 weight percentage or more and 4.0 weight percentage or less in content.

According to such an aluminum composite material, there is given an aluminum composite material high of addition quantity of B or B compound, and excellent also in mechanical properties, such as a tensile characteristic, due to an additive element, such as Zr or Ti. Moreover, the manufacture cost can also be suppressed to be inexpensive.

Further, according to another aspect of the present invention, there is provided a manufacturing method for an aluminum composite material comprising adding, in Al or Al alloy powder, B or B compound having a neutron absorption ability and powder of an additive element for giving a high strength property, and subsequently subjecting to a sintering under pressure.

In this aspect of the invention, the Al or Al alloy powder may preferably be quenched solidified powder, which has a uniform fine structure. The B or B compound may preferably range in content, in terms of a B quantity, 1.5 weight percentage or more and 9 weight percentage or less. Boron carbide ($B_4C$) particles may preferably used as the B compound powder. The A or A alloy powder may preferably have an average particle diameter within 5–150 μm, and the B compound powder to be used may preferably comprise $B_4C$ particles having an average particle diameter within 1–60 μm.

Further, in this aspect of the invention, the additive element powder for giving the high strength property may be powder of Zr, and the Zr may preferably range 0.2 weight percentage or more and 2.0 weight percentage or less in content, and more preferably 0.5 weight percentage or more and 0.8 weight percentage or less. Alternately, the additive element powder for giving the high strength property may be powder of Ti, and the Ti may preferably range 0.2 weight percentage or more and 4.0 weight percentage or less in content.

Further, in this aspect of the invention, the sintering under pressure may comprise one, or combination of two or more, of a hot extrusion, a hot milling, a hot static water pressure pressing, and a hot pressing. In any such method of sintering under pressure, after powder is canned in a can, there is performed a heated vacuum suction to thereby remove gas components and moisture adsorbed on surfaces of particles in the can, and thereafter the can is sealed. Then, the canned powder is subjected to a hot process, with a vacuum kept inside the can. Further, after execution of the sintering under pressure, there preferably be made an adequate thermal process, as necessary.

According to such a manufacturing method for an aluminum composite material, by employment of a powder metallurgical method using a sintering under pressure, there can be achieved an increased addition quantity of B or B compound, as well as addition such as of Zr or Ti, and hence there can manufactured an aluminum composite material excellent also in mechanical properties, such as a tensile characteristic. Accordingly, the neutron absorption ability can be improved, and there can be provided an aluminum composite material excellent in workability as well.

According to another aspect of the present invention, there is provided a basket having a lattice-like section for accommodating an individual used nuclear fuel assembly in a predetermined position in a cask, and manufactured with an aluminum composite material having a neutron absorption ability and made by adding, in Al or Al alloy powder, B or B compound powder having a neutron absorption ability and powder of an additive element for giving a high strength property, and subsequently subjecting to a sintering under pressure.

In this aspect of the invention, the B or B compound may preferably range in content, in terms of a B quantity, 1.5 weight percentage or more and 9 weight percentage or less, and more preferably range, in terms of the B quantity, 2 weight percentage or more and 5 weight percentage or less.

The additive element powder for giving the high strength property may be powder of Zr, and in this case, the Zr may preferably range 0.2 weight percentage or more and 2.0 weight percentage or less in content, and more preferably 0.5 weight percentage or more and 0.8 weight percentage. Alternately, the additive element powder for giving the high strength property may be powder of Ti, and in this case, the Ti may preferably range 0.2 weight percentage or more and 4.0 weight percentage or less in content.

Further, in this aspect of the invention, the lattice-like section of basket may comprise plate members of the aluminum composite material lattice-like combined, or may comprise tube members made by an extrusion of the aluminum composite material and combined by a binding. The binding may preferably be performed by a brazing.

According to such a basket, as an aluminum composite material itself has a high neutron absorption ability and is excelled also of workability, an entire basket body can be manufactured by use of the composite material as a structural member.

According to another aspect of the present invention, there is provided a cask comprising a basket having a lattice-like section for accommodating an individual used nuclear fuel assembly in a predetermined position in the cask, and manufactured with an aluminum composite material having a neutron absorption ability and made by adding, in Al or Al alloy powder, B or B compound powder having a neutron absorption ability and powder of an additive element for giving a high strength property, and subsequently subjecting to a sintering under pressure, a hollow cask body provided with a barrel body for receiving and withstanding a pressure and a neutron shielding part surrounding outside thereof, and configured to accommodate the basket therein, and a lid configured to be attached to and removed from an opening provided in the cask body for the used nuclear fuel assembly to be let therethrough for entry and removal.

In this aspect of the invention, the B or B compound may preferably range in content, in terms of a B quantity, 1.5 weight percentage or more and 9 weight percentage or less, and more preferably range, in terms of the B quantity, 2 weight percentage or more and 5 weight percentage or less. The additive element powder for giving the high strength property may be powder of Zr, and in this case, the Zr may preferably range 0.2 weight percentage or more and 2.0 weight percentage or less in content, and more preferably 0.5 weight percentage or more and 0.8 weight percentage. Alternately, the additive element powder for giving the high strength property may be powder of Ti, and in this case, the Ti may preferably range 0.2 weight percentage or more and 4.0 weight percentage or less in content.

Further, in this aspect of the invention, the lattice-like section of basket may comprise plate members of the aluminum composite material lattice-like combined, or may comprise tube members made by an extrusion of the aluminum composite material and combined by a binding. The binding may preferably be performed by a brazing.

According to such a cask, by provision of a basket excellent of neutron absorption and capable of manufacture at an inexpensive cost, the cask itself is allowed to have an increased neutron shielding function and to be manufactured at an inexpensive cost.

Other objects and features of this invention will become apparent from the following description with reference to the accompanying drawings.

DESCRIPTION OF THE PREFERRED EMBODIMENTS

Figure 1:
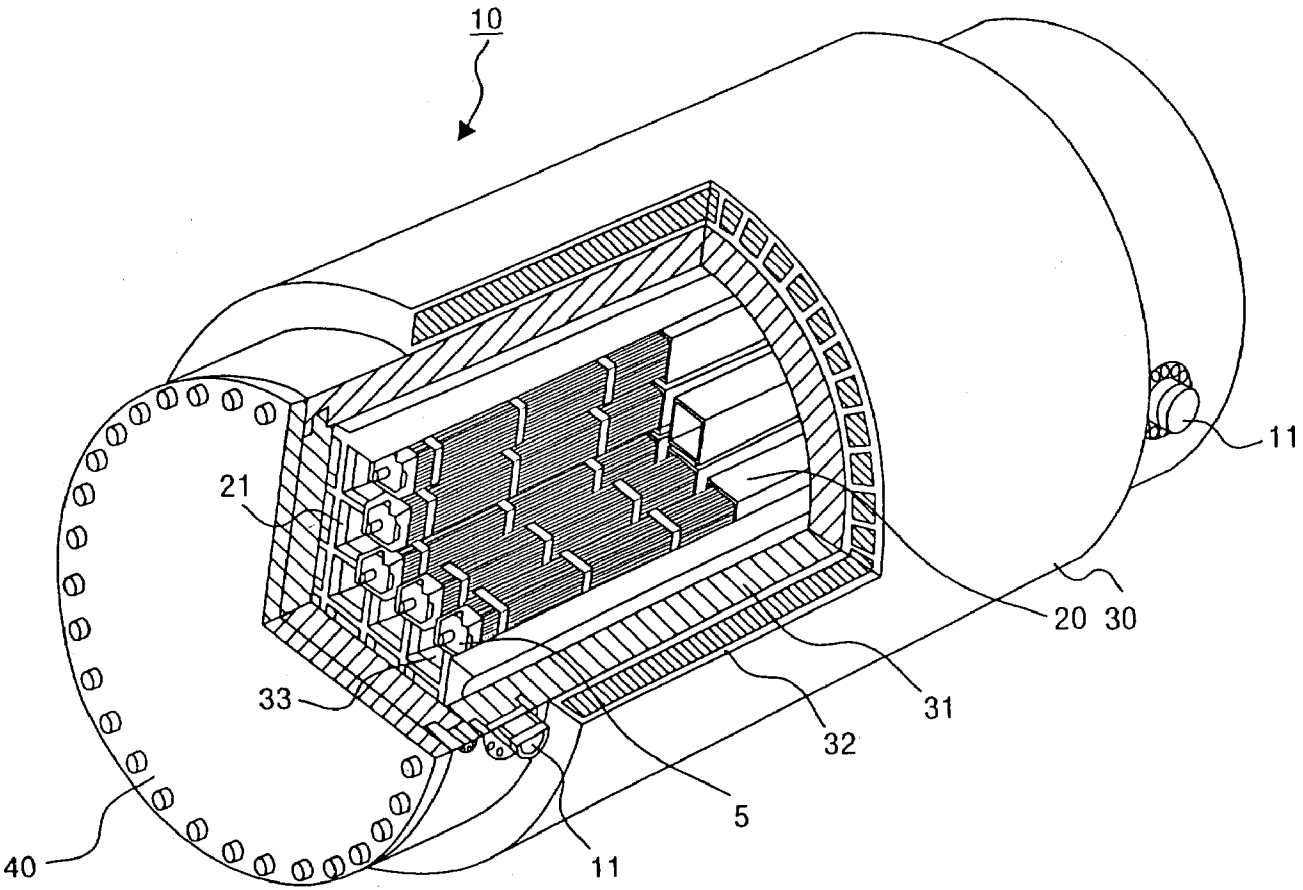
FIG. 1 is a partially sectional perspective view showing a structure of the a cask according to the invention.

Preferred embodiments of an aluminum composite material and a manufacturing method therefor, and a basket and a cask using the same according to the present invention will are explained below with reference to the accompanying drawings.

An aluminum composite material according to the present invention contains, in an Al or Al alloy base phase, B or B compound having a neutron absorption ability and an additive element for giving a high strength property, and is sintered under pressure. The B or B compound may preferably range in content, in terms of a B quantity, 1.5 weight percentage or more and 9 weight percentage or less, and more preferably 2 weight percentage or more and 5 weight percentage or less.

Further, the additive element for giving the high strength property is Zr, for example. In this case, the Zr may preferably range 0.2 weight percentage or more and 2.0 weight percentage or less in content, and more preferably 0.5 weight percentage or more and 0.8 weight percentage or less. Alternately, the additive element for giving the high strength property may be Ti, for example. In this case, the Ti may preferably range 0.2 weight percentage or more and 4.0 weight percentage or less in content. It should be noted that both Zr and Ti can be added.

Such an aluminum composite material is high of addition quantity of B or B compound, and therefore has an excellent neutron absorption ability. Further, as being excellent also in mechanical properties, such as a tensile characteristic, due to an additive element, such as Zr or Ti, there is provided a high workability. This aluminum composite material can thus be employed as a structural member for atomic energy related facilities, for example.

In manufacture of the above-noted aluminum composite material, Al or Al alloy powder prepared by a quench solidification method such as an atomizing method, B or B compound having a neutron absorption ability, and powder of an additive element (either or both of Zr and Ti, for example) for giving a high strength property are mixed together, to be sintered under pressure.

The added quantity of B is within a range of 1.5 weight percentage or more and 9 weight percentage or less, whereas it may preferably be 2 weight percentage or more and 5 weight percentage or less. In the case Zr only is added, the addition quantity ranges 0.2 weight percentage or more and 2.0 weight percentage or less, and preferably it may range 0.5 weight percentage or more and 0.8 weight percentage or less. In the case Ti only is added, the addition quantity ranges 0.2 weight percentage or more and 4.0 weight percentage or less. Zr and Ti can be both added.

The Al or Al alloy powder to be used as a base may be any of pure aluminum raw metals (JIS 1xxx series), Al—Cu aluminum alloys (JIS 2xxx series), Al—Mg alloys (JIS 5xxx series), Al—Mg—Si aluminum alloys (JIS 6xxx series), Al—Zn—Mg aluminum alloys (JIS 7xxx series), and Al—Fe aluminum alloys (Fe content 1–10 weight percentage), as well as Al—Mn aluminum alloys (JIS 3xxx series) for example, and can be selected therefrom in accordance with required characteristics, such as strength, ductility, workability, and heat resistance, without particular limitations.

As the Al or Al alloy, there is used quench solidification powder having a uniform fine structure. As a quench solidification method to obtain the quench solidification powder, known techniques such as a single roll method, a double roll method, and an atomizing method such as by air atomization or gas atomization can be employed. Al alloy powder obtained by such a quench solidification method may preferably have an average particle diameter within 5–150 μm.

This is because in a range of average particle diameter under 5 μm the particles are so fine and tend to aggregate, finally constituting large lumps of particles, and because of a limitation to the manufacture by atomization (the necessity of separating fine powder only renders yield of powder manufacture extremely worsened with a sudden increase in cost). In a range of average particle diameter exceeding 150 μm, it is because of a limitation to the manufacture by atomization method, due such as to a failure of quench solidification, and because of a problem that a uniform mixing with added fine particles becomes difficult. Most preferable average particle diameters range 50–120 μm. Quenching rate for the quench solidification is over $10^{2\circ}$ C./sec, and may preferably be $10^{3\circ}$ C./sec or more.

The B or B compound to be mixed with the Al or Al alloy powder has a particular feature that it exhibits a large absorption ability to high-speed neutrons. As preferable B compounds for use in the invention, there are $B_4C$, $B_2O_3$, etc. Among them, $B_4C$ is particularly preferable as an additive particle to a structural material, such that it has a large B content per unit quantity and, even by addition of a small quantity, can provide a great neutron absorption ability, in addition to that its hardness is very high.

The addition quantity of such B or B compound should range 1.5 or more and 9 or less in weight percentage in terms of a B quantity, and may preferably range 2 or more and 5 or less in weight percentage. This is because of the following.

Assuming an aluminum alloy (or aluminum radical composite material) to be a structural material in an atomic energy field, or more specifically, to be used as a structural material of a storage and transportation container for used nuclear fuel, it necessarily has a member thickness within a range of 5 mm to 30 mm or near. This is because the meaning of using a light aluminum alloy gets absurd if it be a thick member exceeding that range, and on the other hand, for a necessary reliability for structural member to be ensured, an extreme reduction in thickness is difficult, as will be apparent when the strength of an ordinary aluminum alloy is supposed.

In other words, the neutron shielding ability of an aluminum alloy to be used for such an application may well do if it has a necessary and sufficient value for a thickness in the above-noted range, and the addition of B or $B_4C$ by an extreme plenty such as in some prior invention might merely have caused in vain a worsened workability or reduced ductility.

The present inventors made experiments, observing that in the case ordinary $B_4C$ inexpensively available in market is used as a B source, an optimum characteristic for an aimed application can be achieved simply by addition of a quantity of $B_4C$ within a range of 2 to 12 weight percentage, or within 1.5 to 9 weight percentage in terms of a B quantity. If the quantity of $B_4C$ is lowered under the range, it is failed to obtain a necessary neutron absorption ability, and on the other hand, if the addition is in excess of the above-noted range, there is caused not simply a difficulty of manufacture due such as to an occurrence of breaking in a formation such as by extrusion, but also a manufacture of a material low of ductility, with a resultant failure to provide a structural material with a required reliability to be secured.

The powder of B or B compound to be used may preferably have an average particle diameter within 1 μm–60 μm. This is because if the particles have an average particle diameter under 1 μm, they are fine and tend to aggregate, resulting in large lumps of particles, failing to achieve a uniform distribution, causing the yield to be extremely worsened, and because if in excess of 60 μm, they constitute obstacles by themselves, not simply lowing the material strength and adaptability for extrusion, but also worsening the material in adaptability for cutting machining.

Zr or Ti to be added to the Al or Al alloy powder has a characteristic to provide the aluminum composite material with a high strength nature in both room temperature and high temperature circumstances. As powder for Zr or Ti addition, there can be employed powder of metallic Zr or metallic Ti or that of Zr compound or Ti compound. There may for example be employed a Zr oxide as the Zr compound, or a Ti oxide as the Ti compound.

The reason why the addition quantity of Zr or Ti is within the above noted range is as follows. That is, in the case of Zr, the effect to raise the strength is small in a range under 0.2 weight percentage, and on the contrary, in a range exceeding 2.0 weight percentage, there occurs a reduction in ductility and tenacity, causing the strength raising effect to be saturated, as well. In the case of Ti, in a range under 0.2 weight percentage, there is given an insufficient effect to raise the strength, whereas with a content in excess of 4.0 weight percentage, a resultant difficulty in formation of a fine metallic compound provides an increased tendency to reduce the tenacity, so that the strength raising effect also tends to be saturated.

Zr to be added may for example be spongy, as well as Ti to be added.

After the Al or Al alloy powder, B or B compound powder, and Zr or Zr compound powder (or Ti or Ti compound powder) are mixed together, the mixture of powder is sealed in a can made of an Al alloy, and subjected to a heated vacuum degasification. If this step is omitted, the amount of gas in a material to be finally manufactured becomes large, with a failure to obtain an expected mechanical property or with a tendency for a surface to swell during thermal process. An adequate temperature range for the heated vacuum degasification resides in a range of 350° C. to 550° C. Under the lower limit value, there occurs a failure to effect a sufficient degasification, and by exposure to a higher temperature than the upper limit, some material may undergo a significant characteristic deterioration.

After the degasification process, there is performed a sintering under pressure for manufacture of an Al alloy composite material. As a method for the sintering under pressure for manufacture, there can be employed any or combination of a hot extrusion, a hot milling, a hot static water pressure pressing (HIP), and a hot pressing. In the sintering under pressure, there may preferably be set a heating temperature within 350° C. to 550° C., and a time between 5 to 10 minutes.

After the sintering under pressure, there is executed a thermal process, as necessary. For example, there is executed a T6 process of the JIS in a case in which Al alloy powder of Al—Mg—Si series is used as a base, as well as in a case in which Al alloy powder of Al—Cu series is used as a base. However, in cases such as of powder of pure Al or Al—Fe series Al alloy used as a base, no thermal process is necessary, as these cases correspond to a T1 process of the JIS.

By such a manufacturing method, there can be obtained an aluminum composite material containing, in an Al or Al alloy base phase, an amount of B or B compound having a neutron absorption ability and ranging 1.5 weight percentage or more and 9 weight percentage or less in terms of a B quantity, and an amount of Zr or Zr compound ranging 0.2 weight percentage or more and 2.0 weight percentage or less in terms of a Zr quantity, and sintered under pressure. Alternately, there can be obtained an aluminum composite material containing, in place of Zr, an amount of Ti ranging 0.2 weight percentage or more and 4.0 weight percentage or less. Both Zr and Ti may be contained.

It is known that B or B compounds have an excellent ability for absorption of high-speed neutrons. To this point, the composite material may contain an adequate amount of Gd or Gd compounds excellent in ability to absorb low-speed neutrons, as necessary.

Next, embodiments of a basket and a cask according to the present invention will be explained with reference to FIG. 1 to FIG. 3. FIG. 1 is a partially sectional perspective view showing an arrangement of the cask, where designated by reference character 10 is the cask, 20 is the basket, 30 is a cask body, and 40 is a lid.

The cask 10 shown is an accommodation container substantially cylindrical in entirety, and includes as principal components thereof the basket 20 for accommodating used nuclear fuel assemblies (hereafter called "nuclear fuel assemblies") 5 in predetermined positions inside the cask, the cask body 30 provided with a barrel body 31 for receiving and withstanding a pressure and a neutron shielding part 32 surrounding outside thereof, and the lid 40 configured to be attached to and removed from an opening 33 in the cask body 30.

The cask body 30 is a hollow cylindrical container having the basket 20 installed therein, and the opening 33 provided at one end thereof for the nuclear fuel assemblies 5 to be let therethrough for entry and removal.

The basket 20 is a structural body configured to accommodate therein a multiplicity of long bar-like used nuclear fuel assemblies 5, having lattice-like sections elongated in an axial direction of the cask body 30, each respectively defining an accommodation chamber (called "cell") 21 for accommodation of a respective nuclear fuel assembly 5.

The basket 20 has a lattice-like end facing the opening 33 of the cask body 30, and is configured to allow for a nuclear fuel assembly 5 to be accommodated into a respective cell 21 and to be taken out therefrom in a condition in which the lid 40 is removed. The basket 20 is made of the before-mentioned aluminum composite material.

Figure 2:
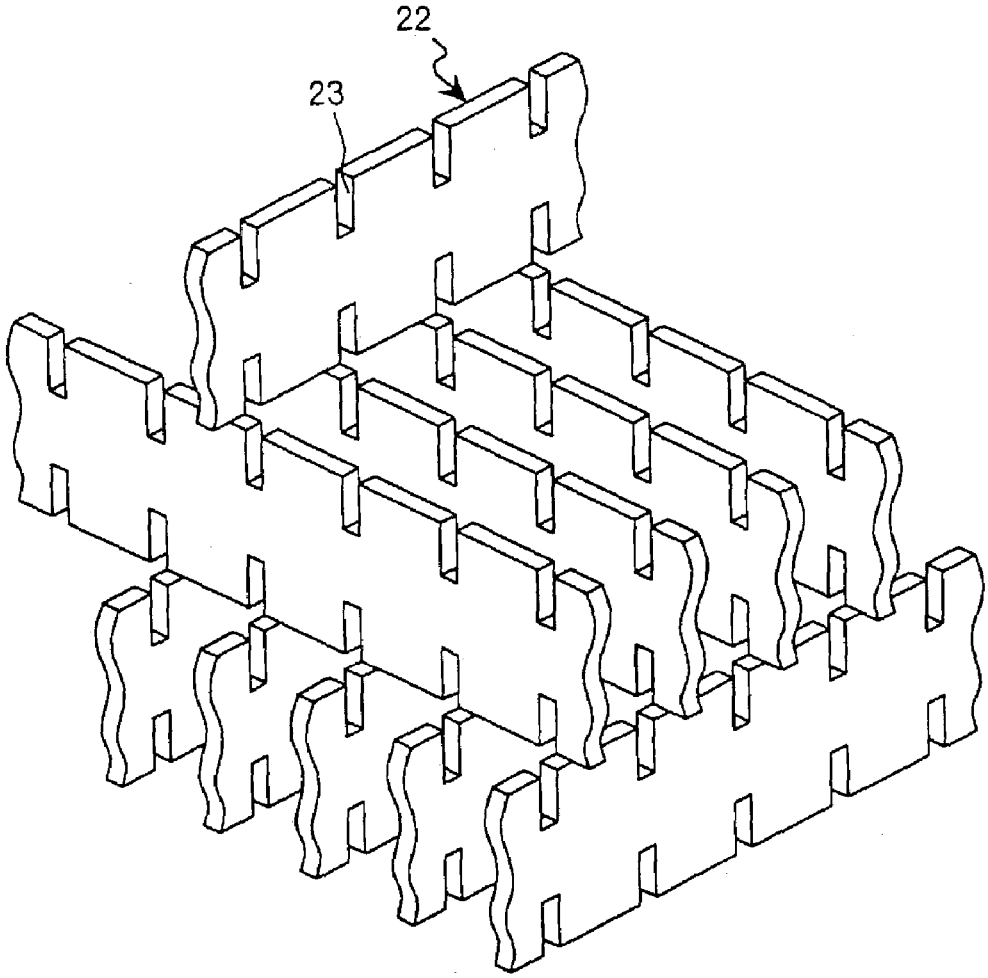
FIG. 2 is an exploded partial perspective view of a first embodiment showing a structure of a basket according to the invention.

FIG. 2 shows a first embodiment of the structure of the basket 20. In this embodiment, plate-like members 22 are employed as structural members of the basket 20, and combined in parallel crosses to form a lattice-like section. The plate-like members 22 each have slits 23 provided in its long sides for engagement, and neighboring plate-like members are adapted to be combined by engaging their slits 23 with each other. In this case, plate-like member 22 is an extruded form of aluminum composite material, entirely made of an identical composite, so that an entirety of the basket 20 has a neutron absorption ability.

Figure 3:
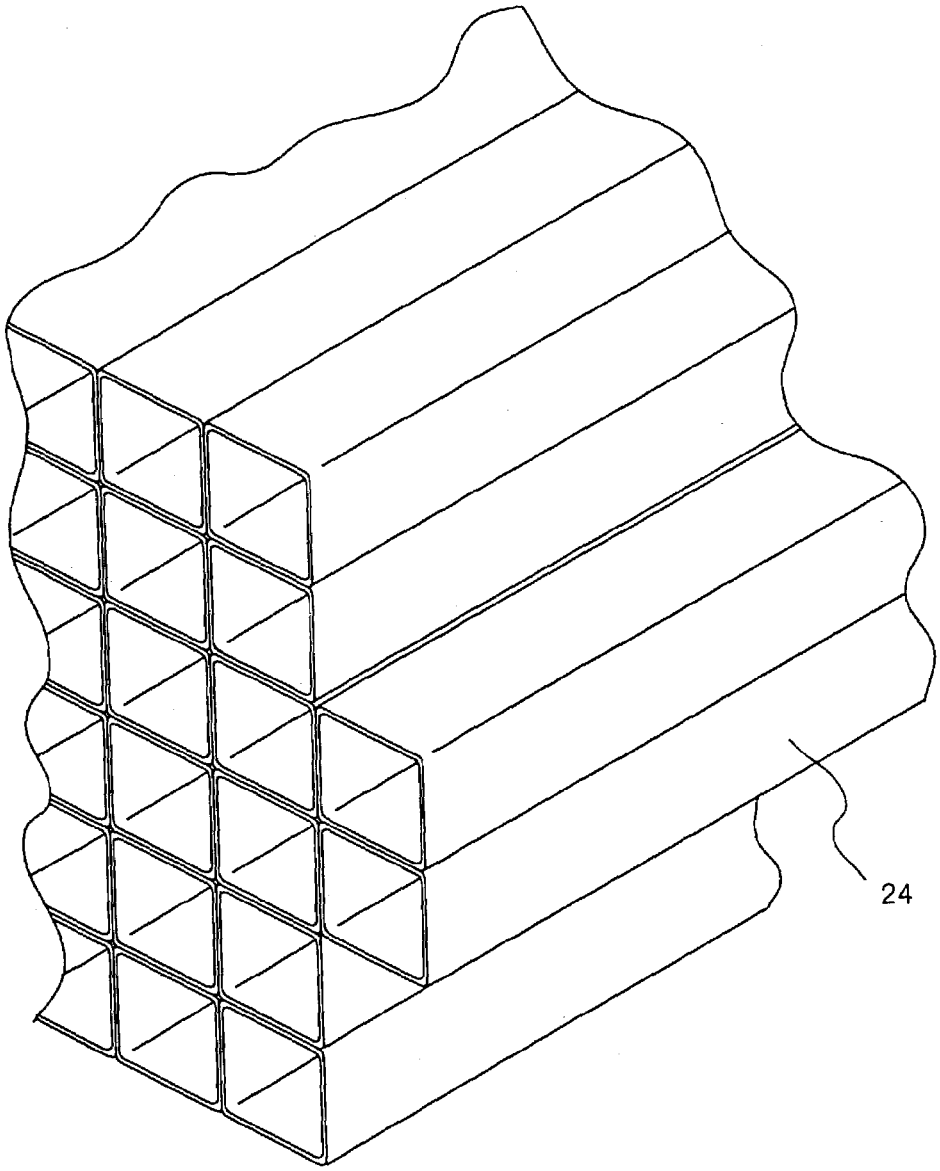
FIG. 3 is an exploded partial perspective view of a second embodiment showing a structure of a basket according to the invention.

FIG. 3 shows a second embodiment of the structure of the basket 20. In this embodiment, there are employed tube members 24 made as extruded forms of the aluminum composite material, substantially rectangular in section, and a multiplicity thereof are combined by binding, with their outsides contacting each other. The method of binding the tube members may be adequately selected from known methods, such as by a welding, brazing, or fastening with screws or rivets through connection members. In this case also, an entirety of the basket 20 substantially has a neutron absorption ability. If the brazing is employed as the binding method, distortion can be reduced, as a merit.

The cask body 30 is constituted with the barrel body 31 made of carbon steel, stainless steel or the like for reception of a withstand pressure, and the neutron shielding part 32 made of a neutron shielding material such as a resin and surrounding an outer circumference thereof. The barrel body 31 has a function as a γ-ray shield as well. The lid 40 to close the opening 33 is configured for a flange-connection to the cask body 30 using bolts, with a sufficient sealing to be secured by known techniques. In the figure, designated by reference character 11 is a trunnion to be hooked when lifting the cask 10 for removal.

According to the embodiments described, an aluminum composite material excellent in neutron absorption ability as well as in mechanical property and high of workability can be used as a structural material, and is thermally processed as necessary after a sintering under pressure, and formed thereafter by extrusion to provide a structural member with a desirable configuration, thereby obtaining the above-noted plate-like member 22 or tube member 24, for example. Then, the basket 20 is manufactured with such plate-like members 22 or tube members 24, without the need of conventional work for a neutron absorbing material to be affixed on a base material, thus achieving a great reduction of man-hours. Further, as the basket 20 is manufactured with members identical in structure, there can be eliminated occurrence of problems such as steps that otherwise might have been formed in a cell 21 due to structural members, or exfoliation of neutron absorbing members.

Next, concrete experimental examples are given below. First, there was made an experiment of an aluminum composite material containing in an Al or Al alloy base phase B or B compound having a neutron absorption ability (without including Zr or Ti. In this experiment, an Al—$B_4C$ particle composite material was manufactured by using a powder metallurgical method, and its mechanical properties were examined Materials Used (1) As the aluminum or aluminum alloy powder to form a base, the following four kinds were used.

Base/powder 250 μm or less in particle diameter was obtained. This was classified into various particle sizes for use (hereafter called "pure Al").

Base/using an Al alloy of g-0.25Cr (JIS 6061), powder was obtained by an $N_2$ gas atomization method. This was classified to a particle size under 150 μm (average 95 μm) for use (hereafter called "60601Al (Al—Mg—Si series)").

Base/using an Al alloy of i-0.1V-018Zr (JIS 2219), powder was obtained by an $N_2$ gas atomization method. This was classified to a particle size under 150 μm (average 95 μm) for use (hereafter called "2219Al (Al—Cu series)").

Base/using an Fe series Al alloy, powder was obtained by an $N_2$ gas atomization method. This was classified to a particle size under 150 μm (average 95 μm) for use (hereafter called "Fe series Al").

(2) As an additive particle, commercially available $B_4C$ was used. Extracted specifications therefore are listed in Table 1 and Table 2.

TABLE 1

| Specifications for additive particles (extracted) | |
|---|---|
| B (weight percentage) | 76 |
| C (weight percentage) | 22 |
| Fe (weight percentage) | 0.1 |
| Average particle diameter (μm) | 23 |
| Accumulated 90% particle diameter (μm) | 44.93 |
| Accumulated 95% particle diameter (μm) | <60 |

TABLE 2

| | Name (kinds) | Average particle diameters |
|---|---|---|
| (1) | For metal addition | 23 μm |
| (2) | For metal addition | 0.8 μm |
| (3) | #800 for polishing | 9 μm |
| (4) | #280 for polishing | 59 μm |
| (5) | #250 for polishing | 72 μm |

EXAMPLE 1

Powders Used

Pure Al powder (average 118 μm) classified to 250 μm or less, and 6061Al, 2219Al, and Fe series Al powder classified to 150 μm or less were used. As an additive particle, $B_4C$ for metal addition of average particle diameter 23 μm was used.

Preparation of Sample (1) Billet Preparation

As a first step, using a cross rotary mixer, the above-noted powder and additive particles were mixed for 10–15 minutes. In this experiment, twelve kinds of samples were prepared, by combinations of bases and B addition quantities (indicated by a value of calculated weight percentage of B) listed in Table 3.

TABLE 3

| Mixed powder | | | |
|---|---|---|---|
| Sample | Base | $B_4C$ addition quantity (converted to B quantity %) | Thermal process |
| A | pure Al | 0 | no (T1) |
| B | pure Al | 2.3 | no (T1) |
| C | pure Al | 4.7 | no (T1) |
| D | pure Al | 9.0 | no (T1) |
| E | pure Al | 11.3 | no (T1) |
| F | 6061 Al | 2.3 | yes (T6) |
| G | 2219 Al | 2.3 | yes (T6) |
| H | Fe series Al | 0 | no (T1) |
| I | Fe series Al | 2.3 | no (T1) |
| J | Fe series Al | 4.7 | no (T1) |
| K | Fe series Al | 9.0 | no (T1) |
| L | Fe series Al | 11.3 | no (T1) |

As a second step, for canning, the mixture of base powder and additive particles was sealed in a can. Specifications for the can used are as follows.

Material: JIS 6063 (aluminum alloy seamless tube with fully welded bottom plate identical of material)

Diameter: 90 mm

Length: 300 mm

Can thickness: 2 mm

As a third step, a heated vacuum degasification was performed. In this step, canned powder mixture was heated up to 480° C., and inside the can was vacuum-suctioned to 1 Torr or less, which was kept for 2 h. By this degasification, gas components and moisture adsorbed on surfaces of powder in the can were removed, thereby completing preparation of a material to be extruded (hereafter called "billet").

(2) Extrusion

In this step, a billet made by the above-noted procedure was hot extruded, using a 500-ton extruder. Temperature in this case was 430° C., and by an extrusion ratio of approx. 12 a flat extruded configuration was formed, as follows.

Extrusion time for the formation by extrusion was 430 sec.

[Extruded Configuration (Section)]

Width: 48 mm

Thickness: 12 mm (3) Thermal Process (T6 Process)

In this experiment, after the formation by extrusion, a thermal process was executed simply for samples F and G in Table 3. In thermal process for the sample F, a thermal process to make a solid solution was performed for 2 hours at 530° C., and followed by a water cooling, and an aging process was performed for 8 hours at 175° C., before an air cooling. In thermal process for the sample G, a solid solution making thermal process was performed for 2 hours at 530° C. and followed by a water cooling, and an aging process was performed for 26 hours at 190° C., before an air cooling. By this thermal process, the sample preparation was completed. For other samples, a cooling after hot extrusion was followed by a natural aging, thereby effecting a T1 process.

Evaluation

Respective samples A to L prepared by the steps described were evaluated in the following manner. For the samples F and G, T6 materials subjected to the above-noted thermal process were employed to make their evaluation. For the other samples (A to E, H to L), T1 materials without thermal process were employed for evaluation.

(1) Microscopic Structure Observation

This was made for all samples A to L, in a central part of the extruded material to an L section (parallel to an extruded direction) and a T section (perpendicular to the extruded direction). By the results, it was confirmed that any sample had a structure in which $B_4C$ particles were uniformly fine dispersed in an aluminum alloy matrix.

(2) Tensile Test

This tensile test was performed under two temperature conditions, at a room temperature and at 250° C. Tensile test at room temperature was made for all samples A to L, by setting their numbers n of specimens to 2 (n=2), to take an average value of the two. Tensile test at 250° C. was made for eight samples, excluding samples A and C to E, by setting their n=2, to take an average value of the two. In either tensile test, a round bar specimen having a parallel part of a 6 mm diameter was used therefor. For the tensile test at 250° C., however, the specimen was kept at 250° C. for 10 hours, before execution of the test.

Results of this test are listed in Table 4.

TABLE 4

| Temperature | Sample | Thermal process | 0.2% withstand force (MPa) | Tensile strength (MPa) | Breaking extension (%) |
|---|---|---|---|---|---|
| Room temperature | A | T1 | 56 | 105 | 40 |
| | B | T1 | 62 | 112 | 39 |
| | C | T1 | 64 | 114 | 33 |
| | D | T1 | 70 | 117 | 22 |
| | E | T1 | 80 | 110 | 8 |
| | F | T6 | 278 | 307 | 49 |
| | G | T6 | 291 | 426 | 27 |
| | H | T1 | 165 | 262 | 60 |
| | I | T1 | 175 | 271 | 21 |
| | J | T1 | 184 | 270 | 18 |
| | K | T1 | 199 | 281 | 13 |
| | L | T1 | 206 | 267 | 5 |
| 250° C. (after 100 h holding) | B | T1 | 32 | 48 | 36 |
| | F | T6 | 74 | 98 | 23 |
| | G | T6 | 134 | 185 | 13 |
| | H | T1 | 96 | 143 | 23 |
| | I | T1 | 107 | 149 | 20 |
| | J | T1 | 107 | 153 | 12 |
| | K | T1 | 112 | 160 | 12 |
| | L | T1 | 115 | 150 | 10 |

Experimental results of table 4 show that 0.2% withstand force is within a range of 56 MPa (sample A) to 291 MPa (sample G) at room temperature, and within a range of 32 MPa (sample B) to 134 MPa (sample G) at high temperature of 250° C.

Tensile strength is within a range of 105 MPa (sample A) to 426 MPa (sample G) at room temperature, and within a range of 48 MPa (sample B) to 185 MPa (sample G) at high temperature of 250° C., and it is seen that even at high temperature as well as at room temperature, they are better than the tensile strength of Boral, that is, 41 MPa at room temperature (see Table 5).

Further, breaking extension is within a range of 5% (sample L) to 60% (sample H) at room temperature, and within a range of 10% (sample L) to 36% (sample B) at high temperature of 250° C., showing at either temperature better results than the extension of Boral, that is, 1.2% (see Table 5).

Figure 4:
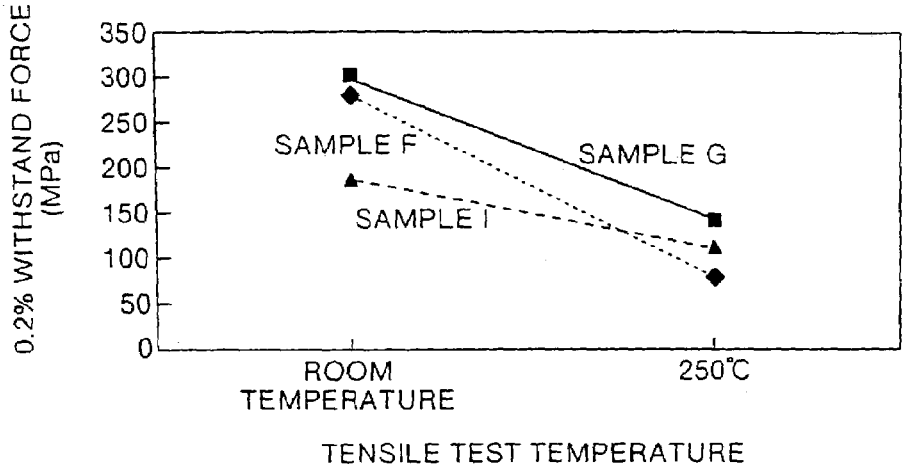
FIG. 4 is a graph of a mechanical property of an Al composite material, showing a relationship between a 0.2% withstand force (MPa) and temperature (° C.), for test samples F, G and I in table 3.
Figure 5:
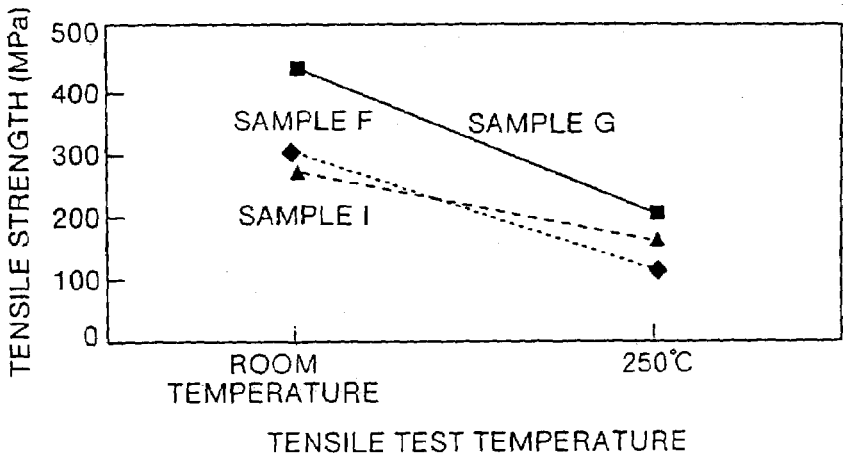
FIG. 5 is a graph of a mechanical property of an Al composite material, showing a relationship between a tensile strength (MPa) and temperature (° C.) for test samples F, G and I in table 3.

FIG. 4 and FIG. 5 are graphs showing an effect of temperature to tensile characteristic, both plotting values test results of samples F, G and I (each for a B quantity of 2.3 weight percentage) in Table 4. It is seen from the graphs that the sample G gives the highest values for both 0.2% withstand force and tensile strength, but is susceptive to effects of temperature rise as the inclination is relatively large.

The sample I has the lowest values among the three samples for both 0.2% withstand force and tensile strength, but the inclination to temperature rise is smallest. Therefore, at high temperature of 250° C., it is reversed to the sample F, thus showing that the temperature effect thereon is smallest among the three samples. The sample F has an increased inclination in particular for 0.2% withstand force, which means it is susceptive to effects of temperature rise.

Figure 6:
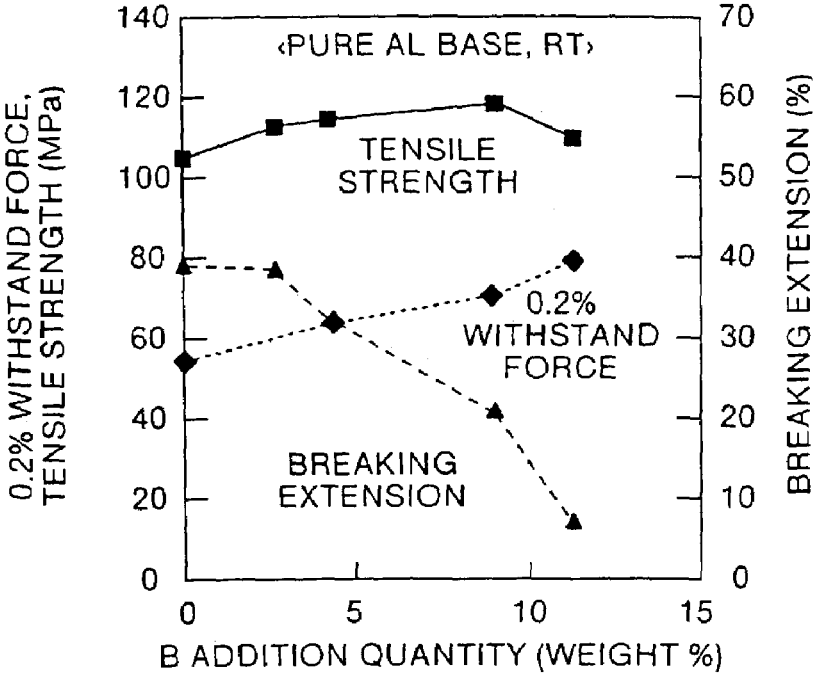
FIG. 6 is a graph of a mechanical property of an Al composite material, showing an effect of addition quantity of B at room temperature, for composite materials of pure Al base (test samples A to E in table 3)
Figure 7:
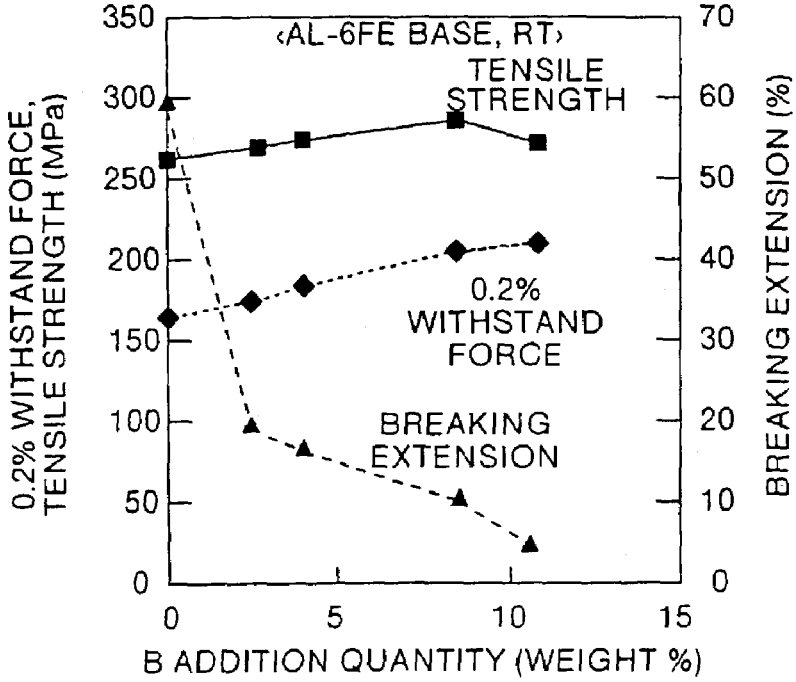
FIG. 7 is a graph of a mechanical property of an Al composite material, showing an effect of addition quantity of B at room temperature, for composite materials of Al-6Fe base (test samples H to L in table 3)
Figure 8:
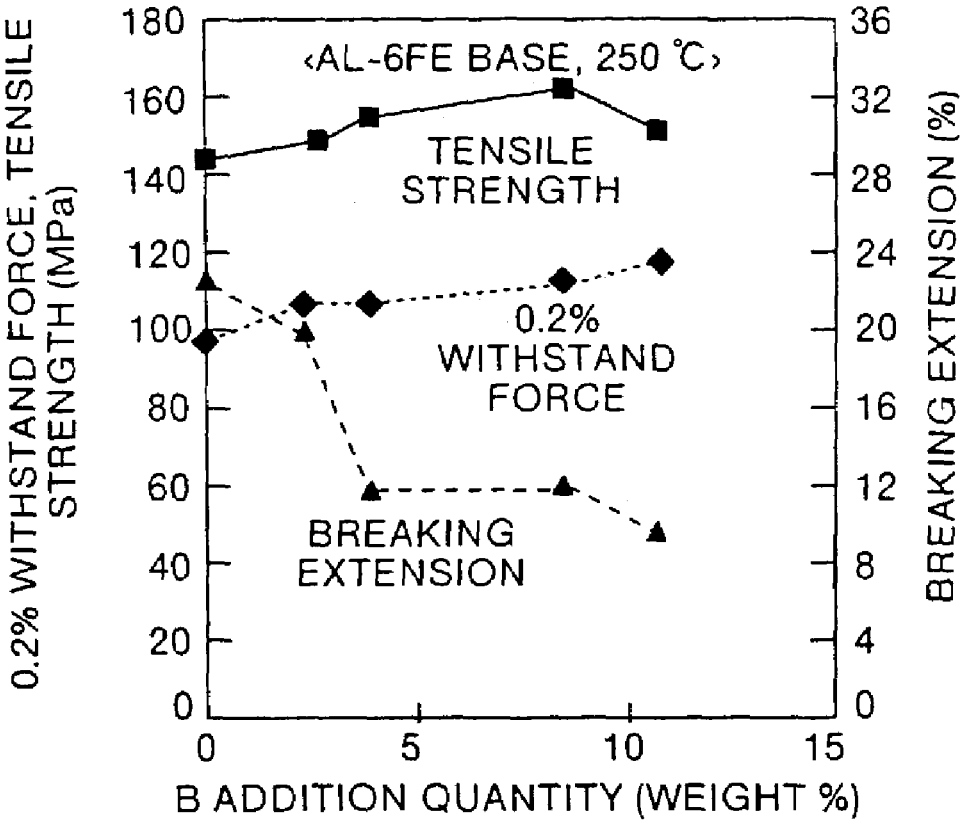
FIG. 8 is a graph of a mechanical property of an Al composite material, showing an effect of addition quantity of B at 250° C., for composite materials of Al-6Fe base (test samples H to L in table 3)

FIGS. 6 to 8 are graphs showing an effect of B addition quantity (weight percentage) to tensile test results. FIG. 6 plots values (see Table 4) of 0.2% withstand force (MPa), tensile strength (MPa), and breaking extension (%) for pure Al base samples A to E, providing a temperature condition to be room temperature. It is seen from this graph that as the B addition quantity is increased, the 0.2% withstand force (MPa) indicated by dot lines and the tensile strength (MPa) indicated by solid lines become larger, and on the contrary, the breaking extension (%) indicated by broken lines become smaller.

FIG. 7 plots values (see Table 4) of 0.2% withstand force (MPa), tensile strength (MPa), and breaking extension (%) for Fe series Al (Al-6Fe) base samples H to L, providing a temperature condition to be room temperature. It is seen from this graph that as the B addition quantity is increased, the 0.2% withstand force (MPa) indicated by dot lines and the tensile strength (MPa) indicated by solid lines become larger, like FIG. 6. However, when B is added by 2.3 weight percentage, the breaking extension (%) indicated by broken lines is suddenly lowered in comparison with addition-free state, whereas even when the B quantity is increased from 2.3 weight percentage to 4.7 weight percentage, associated reduction is kept small.

FIG. 8 plots values (see Table 4) of 0.2% withstand force (MPa), tensile strength (MPa), and breaking extension (%) for Fe series Al (Al-6Fe) base samples H to L, like FIG. 7, providing a temperature condition to be hot room temperature of 250° C. It is seen from this graph that as the B addition quantity is increased, the 0.2% withstand force (MPa) indicated by dot lines and the tensile strength (MPa)

indicated by solid lines become larger, like FIG. 6 and FIG. 7. As to the breaking extension (%) indicated by broken lines, although the phenomenon of FIG. 7 in which a suddenly drop is caused by addition of 2.3 weight percentage of B in comparison with addition-free state is eliminated, and an entire value is low, there is given a tendency for the value to moderately go down like FIG. 6, as the B quantity is increased.

On the above three graphs (FIG. 6 to FIG. 8), there can be confirmed a common tendency irrespective of matrix structure such that, as $B_4C$ particle addition quantity exceeds 9% in B conversion, the breaking extension suddenly drops while 0.2% withstand force is almost kept from rising, and also the tensile strength goes down, accompanying therewith. Although respective materials show greater extensions than Boral (see Table 5), when assuming a practical use as a structural material for a reactor or a container for used nuclear fuel, an extension of 10% or more at room temperature is a lowest necessary value for reliability, and it can be concluded that the $B_4C$ addition quantity to meet this should be 9% or less in B conversion.

Although those small of B quantity have no problems in strength and ductility, a lower limit of addition quantity should naturally be determined from a necessary neutron absorption ability, and the value is 1.5 weight percentage in B conversion, as described.

Among the test results of Table 4, for six kinds of samples B, C, F, G and J (each having a B quantity of 2.3 weight percentage or 4.7 weight percentage), their B quantities (weight percentage), tensile strengths (MPa), and extensions (%) are extracted to be listed in Table 5 below, for comparison with values of conventional articles using a dissolution method. In Table 5, tensile strength and extension are values at a room temperature.

TABLE 5

| Material | | B quantity weight percentage | Tensile strength (MPa) | Extension (%) |
|---|---|---|---|---|
| Composite material | Pure Al composite material (No. B) | 2.3 | 112 | 39 |
| | Pure Al composite material (No. C) | 4.7 | 114 | 33 |
| | Al—Mg—Si series composite material (No. F) | 2.3 | 307 | 49 |
| | Al—Cu series composite material (No. G) | 2.3 | 429 | 27 |
| | Al—Fe series composite material (No. I) | 2.3 | 271 | 21 |
| | Al—Fe series composite material (No. J) | 4.7 | 270 | 18 |
| Conventional articles | Al—Mg series alloy | 0.9 | 245 | 20 |
| | Al—Mg—Si series alloy | 0.9 | 270 | 12 |
| | Al—Zn—Mg series alloy | 0.9 | 500 | 11 |
| | Al—Cu series alloy | 0.9 | 370 | 15 |
| | Al—Mn series alloy | 0.9 | 150 | 11 |
| | Boral | 27.3 | 41 | 1.2 |

First, from comparison of B addition quantity, it is seen that an aluminum composite material manufactured by the above-noted manufacturing method in which an addition of 2.3 or 4.7 weight percentage is made has a neutron absorption ability higher by commensurate fraction as the B addition quantity is larger than respective Al alloys of 0.9 weight percentage. Although Boral's B addition quantity is as very high as 27.3 weight percentage, it can be seen that the workability is lean, because the tensile strength and extension are extremely low as will be described later.

Next, by comparison of tensile strength, it is seen that in aluminum composite materials the pure Al composite material (sample B) of 2.3 weight percentage in B quantity has the lowest value of 112 MPa, and in conventional articles an Al—Mn series alloy has the lowest value of 150 MPa. However, the sample B has a higher B addition quantity than the conventional article, and better at neutron absorption ability, and as the extension also exhibits a by far larger value than a maximum of 20% in conventional articles, it should be bearable to a practical use in regard of workability as well. In particular, when compared with Boral, because the tensile strength and extension characteristics are extremely high, it will be understood that the workability is excellent.

When the base is limited to Al alloy, an Al—Fe series composite material (sample J) with a B quantity of 4.7 weight percentage has the lowest value of tensile strength, which value is 270 MPa.

Among aluminum composite materials, the best in tensile strength is an Al—Cu series composite material (sample G) with a B quantity of 2.3 weight percentage, of which the value is 429 MPa. To this point, the best in tensile strength in conventional articles is an Al—Zn—Mg series alloy of 500 MPa, while the extension in this case is as low as 11%, which is lower than the lowest value 18% among aluminum composite materials in Table 5. This tendency, that is such a tendency that the extension is low (11 to 20%) in comparison with the tensile strength, is common to conventional B-added aluminum alloys, and taking into account the B content as well, it can be concluded that they are wholly low in comparison with extensions (18 to 49%) of aluminum composite materials.

Based on Table 5, comparison is now made between aluminum composite material and aluminum alloy (conventional article) of identical series. First, in comparison between Al—Mg—Si series composite material (sample F) and Al—Mg—Si series alloy, the composite material has a better value in any of B quantity, tensile strength, and extension. That is, the B quantity is 2.3 weight percentage relative to 0.9 weight percentage, the tensile strength is 307 MPa relative to 270 MPa, and the extension is 49% relative to 12%, each value being higher at the composite material end.

Also in comparison between Al—Cu series composite material (sample G) and Al—Cu series alloy, the composite material has a better value in any of B quantity, tensile strength, and extension. That is, the B quantity is 2.3 weight percentage relative to 0.9 weight percentage, the tensile strength is 429 MPa relative to 370 MPa, and the extension is 27% relative to 15%, each value being higher at the composite material end.

Like this, aluminum composite materials can have a higher B quantity added, and are excellent in tensile characteristics such as tensile strength and extension, as well, so that high workability can be achieved. In particular, taking into account the use as a structural material such as for a transportation or storage container for used nuclear fuel, it is preferable to have mechanical properties of a tensile strength to be 98 MPa and an extension to be 10% or more at 250° C., while it is substantially confirmed from the test results at 250° C. that they can be achieved by using other aluminum alloy powder than pure Al powder as the base.

EXAMPLE 2

Powder Classification

Powder of a JIS 6N01 structure prepared by air atomization was classified by sieves of various sizes. Used sieve sizes and "minus sieve" average particle diameters and yields of classification in respective cases are listed in

TABLE 6

| Sieve size (μm) | Minus sieve average particle diameter (μm) | Classification yield (%) |
|---|---|---|
| 355 | 162 | 99 |
| 250 | 140 | 88 |
| 180 | 120 | 60 |
| 105 | 52 | 21 |
| 45 | 21 | 5 |
| 32 | 5 | 3 |

It can be confirmed that the yield of classification suddenly drops by reducing sieve size, though particle size distribution is somewhat variable by alloy structures as well as by atomizing conditions. Assuming the use in an industrial scale, it should concluded that powder of 45 μm or less giving a single figure of yield is impractical.

Preparation of Sample

6N01 powder of particle sizes in Table 6 and five kinds of $B_4C$ particles in Table 2 were mixed by combinations in Table 7. $B_4C$ addition quantities were each 3 weight percentage (2.3 weight percentage in B conversion), and mixing time was 10 to 15 minutes, like the embodiment 1. Powder completed of mixing was subjected, in like procedures to the embodiment 1, to a canning, heated vacuum degasification, and extrusion, obtaining an extruded member having a sectional configuration of 48 mm×12 mm. No thermal process was executed.

TABLE 7

| No. | Used 6N01 powder average particle diameters (μm) | Used $B_4C$ average particle diameters (μm) |
|---|---|---|
| 1 | 5 | 9 |
| 2 | 5 | 23 |
| 3 | 5 | 59 |
| 4 | 21 | 9 |
| 5 | 21 | 23 |
| 6 | 21 | 59 |
| 7 | 100 | 9 |
| 8 | 100 | 23 |
| 9 | 100 | 59 |
| 10 | 149 | 9 |
| 11 | 149 | 23 |
| 12 | 149 | 59 |
| 13 | 5 | 0.8 |
| 14 | 5 | 72 |
| 15 | 149 | 0.8 |
| 16 | 149 | 72 |
| 17 | 162 | 9 |
| 18 | 162 | 59 |

Evaluation (1) Microscopic Structure Observation

At a head, a middle part, and a tail of each extruded member, their sectional central parts and peripheral parts (six points in total) were each subjected to an image analysis of an L section (parallel to an extruded direction) microscopic structure, and examinations on $B_4C$ particles, for presence or absence of their local aggregation and a uniformity of overall distribution.

More specifically, at a respective observation point, five view fields (one view field is 1 mm×1 mm) were each subjected to an area ratio measurement of $B_4C$ particle (because $B_4C$ has a specific weight of approx. 2.51, assuming the specific value of pure Al to be 2.7, the weight percentage of $B_4C$ in Al alloy can be roughly calculated such that volume percentage×2.51/2.7. On the other hand, the area ratio of $B_4C$ in section can be deemed to be substantially equal to volume percentage. Accordingly, there was assumed a standard value of $B_4C$ area ratio, such that 3%×2.7/2.51=2.8%.)

Judgment was made for "aggregation to be presents" if the $B_4C$ area ratio in a single view field exceeds the standard value times two (that is 5.6%) even at a single point, and for "distribution not to be uniform" if an average of area ratios of the five view fields in each position deviates out of the standard value +/−0.5% (that is a range of 2.3 to 3.3%). Results therefrom are listed in Table 8.

TABLE 8

| No. | Used 6N01 powder average particle diameters (μm) | Used $B_4C$ average particle diameters (μm) | Judgment of $B_4C$ distribution | |
|---|---|---|---|---|
| | | | Aggregation | Uniformity |
| 1 | 5 | 9 | no | uniform |
| 2 | 5 | 23 | no | uniform |
| 3 | 5 | 59 | no | uniform |
| 4 | 21 | 9 | no | uniform |
| 5 | 21 | 23 | no | uniform |
| 6 | 21 | 59 | no | uniform |
| 7 | 100 | 9 | no | uniform |
| 8 | 100 | 23 | no | uniform |
| 9 | 100 | 59 | no | uniform |
| 10 | 149 | 9 | no | uniform |
| 11 | 149 | 23 | no | uniform |
| 12 | 149 | 59 | no | uniform |
| 13 | 5 | 0.8 | yes | uniform |
| 14 | 5 | 72 | no | not uniform |
| 15 | 149 | 0.8 | yes | uniform |
| 16 | 149 | 72 | no | uniform |
| 17 | 162 | 9 | no | uniform |
| 18 | 162 | 59 | no | uniform |

In each of alloy Nos. 1–12 in which the average particle diameter of 6N01 powder was 5–150 μm and that of $B_4C$ particles was 1–60 μm, there was obtained a good $B_4C$ distribution, but in alloy Nos. 13 and 15 which used $B_4C$ particles as fine as 0.8 μm in average, there were developed local aggregations. In alloy No. 14 in which coarse $B_4C$, 72 μm in average, was added to fine Al alloy powder 5 μm in average, there was observed unevenness in particle distribution between respective positions in the extruded member.

(2) Normal Temperature Tensile Test

Extruded members were each subjected to a tensile test under normal temperature. Configuration of test specimen was a round bar specimen having a parallel part of a 6 mm diameter, like the embodiment 1. Results are listed in Table 9. Assuming "breaking extension 10% or more" to be a criterion value for conformity as described in the embodiment 1, it is seen that this is met by each of alloy Nos. 1–12. Contrary thereto, in No. 14 and No. 16 in which coarse $B_4C$ as 72 μm in average was added, as well as in No. 17 and No. 18 of which the average particle diameter of base powder was as large as 162 μm, there was observed a significant reduction of ductility, resulting in a failure to meet the criterion.

Putting the foregoing results together, it can be confirmed that in order to obtain a material provided with a uniform structure free such as of $B_4C$ aggregation (i.e. uniform neutron absorption ability) and concurrently with a required ductility to secure a reliability as a structural member, it is necessary and unavoidable to control the particle diameter of base powder and that of additive particles within ranges according to the present invention.

TABLE 9

| No. | Used 6N01 powder average particle diameters (μm) | Used $B_4C$ average particle diameters (μm) | Test results 0.2% withstand force (Mpa) | Tensile strength (Mpa) | Breaking extension (%) |
|---|---|---|---|---|---|
| 1 | 5 | 9 | 83 | 151 | 16 |
| 2 | 5 | 23 | 80 | 143 | 13 |
| 3 | 5 | 59 | 73 | 129 | 11 |
| 4 | 21 | 9 | 81 | 153 | 22 |
| 5 | 21 | 23 | 79 | 150 | 19 |
| 6 | 21 | 59 | 71 | 132 | 14 |
| 7 | 100 | 9 | 75 | 148 | 21 |
| 8 | 100 | 23 | 76 | 149 | 15 |
| 9 | 100 | 59 | 76 | 141 | 14 |
| 10 | 149 | 9 | 70 | 143 | 14 |
| 11 | 149 | 23 | 68 | 134 | 12 |
| 12 | 149 | 59 | 62 | 131 | 11 |
| 13 | 5 | 0.8 | 87 | 157 | 21 |
| 14 | 5 | 72 | 72 | 123 | 7 |
| 15 | 149 | 0.8 | 75 | 147 | 11 |
| 16 | 149 | 72 | 56 | 129 | 8 |
| 17 | 162 | 9 | 70 | 142 | 9 |
| 18 | 162 | 59 | 63 | 125 | 7 |

EXAMPLE 3

Preparation of Sample

Billets were prepared by processes and components in Table 10, and subjected to an extrusion under 430° C. Pure Al and Al-6Fe alloy powder used there were the same as those used in the embodiment 1, the former being air atomized powder classified to 250 μm or less (118 μm in average), the latter being $N_2$ gas atomized powder classified to 150 μm or less (95 μm in average). Used $B_4C$ particles were 23 μm in average.

Powder distributed to respective component was mixed by a cross rotary mixer for 20 minutes. Thereafter, in processes A to E, following similar procedures to the embodiments 1 and 2, canning and heated vacuum degasification were performed to provide billets, which were subjected to extrusion. Temperature then used for vacuum degasification was 350° C. in process A, 480° C. in B, 550° C. in C, 300° C. in D, and 600° C. in E, while associated extrusion was made at 430° C. in any case. Extruded configuration was 48 mm×12 mm, like the embodiment 1.

In process F, mixed powder was heated for two hours in a furnace with a 200° C. under pressure reduced to 4–5 Torr, and thereafter filled in a rubber form in the atmospheric air, to be molded by CIP (cold static water pressure compression). Obtained mold having a density of approx. 75% (void ratio 25%) was heated in the atmospheric air up to 430° C., and subjected to an extrusion. Extruded configuration was 48 mm×12 mm. In process G, mixed powder was directly CIP molded, and heated in the atmospheric air up to 430° C., to be extruded. Extruded configuration was 48 mm×12 mm.

TABLE 10

| Used powder | | $B_4C$ addition quantity (weight percentage) (%) | Processes |
|---|---|---|---|
| Pure Al | (<250 μm) | 3 | A (350° C. degasification) |
| | | 3 | B (480° C. degasification) |
| | | 3 | C (550° C. degasification) |
| Al-6Fe | (<150 μm) | 3 | A (350° C. degasification) |
| | | 3 | B (480° C. degasification) |
| | | 3 | C (550° C. degasification) |

TABLE 10-continued

| Used powder | | $B_4C$ addition quantity (weight percentage) (%) | Processes |
|---|---|---|---|
| Pure Al | (<250 μm) | 3 | D (300° C. degasification) |
| | | 3 | F (degasification without canning) |
| | | 3 | G (without degasification) |
| Al-6Fe | (<150 μm) | 3 | D (300° C. degasification) |
| | | 3 | E (600° C. degasification) |

Evaluation

For each extruded member, there were performed a surface observation of the extruded member, a normal temperature tensile test in the longitudinal direction, and a measurement of the hydrogen gas quantity. The gas quantity measurement was performed in a vacuum melting extraction-mass spectrography conforming to LIS A06.

Results are listed in Table 11. Of those materials manufactured by using processes A–C corresponding to the scope of claims of the present invention, the results were good on each of the hydrogen gas quantity and surface conditions as well as mechanical properties of extruded member. However, in processes departing from the scope of claims of the present invention, the following problems occurred.

In process D in which degasification was performed at a lower temperature than the scope of the invention, hydrogen that could have not been removed from powder surfaces was released when extruding, making bubbles just under skins of the extruded member, causing a so-called "swelling" defect.

Al—Fe series alloys have a high strength to be achieved with fine particles of inter-metallic compounds uniformly dispersed by a quench solidification effect. However, in process E in which degasification was performed at an extremely high temperature, such compounds were made large and coarse, causing sudden reduction of strength and ductility.

In process F in which degasification was made without canning, because it was unavoidable to experience steps exposed to the air until extrusion, and the degasification temperature was extremely low, the hydrogen gas quantity was near "without degasification", and a surface swelling occurred on the extruded member, in addition to that strength and ductility also had low values.

In process G in which no degasification was performed, residual hydrogen gases were very much, so that swelling was caused, and strength and ductility also had low values.

From the foregoing, it was confirmed that in order to manufacture an Al composite material having good characteristics even if any matrix alloy is used, the use of a manufacturing method disclosed in the invention is necessary and indispensable.

TABLE 11

| Bases | Processes | Extruded member surface | Tensile characteristics: Withstand force (MPa) | Tensile characteristics: Tensile strength (MPa) | Tensile characteristics: Extension (%) | Hydrogen gas quantity (cc/100 g) |
|---|---|---|---|---|---|---|
| Pure Al | A (350° C. degasification) | Good | 58 | 105 | 21 | 9.0 |
| | B (480° C. degasification) | Good | 62 | 112 | 39 | 3.1 |
| | C (550° C. degasification) | Good | 63 | 114 | 41 | 2.9 |
| Al-6Fe | A (350° C. degasification) | Good | 201 | 279 | 10 | 8.8 |
| | B (480° C. degasification) | Good | 199 | 281 | 13 | 3.0 |
| | C (550° C. degasification) | Good | 195 | 282 | 15 | 2.9 |
| Pure Al | D (300° C. degasification) | Swell | 49 | 88 | 11 | 17.1 |
| | F (degasification without canning) | Swell | 43 | 79 | 17 | 31.0 |
| | G (without degasification) | Swell | 41 | 78 | 7 | 39.2 |
| Al-6Fe | D (300° C. degasification) | Swell | 224 | 291 | 8 | 16.8 |
| | E (600° C. degasification) | Good | 91 | 127 | 7 | 2.9 |

Experiment 4

To pure Al powder made by air atomization and classified to 250 μm or less, 3 weight percentage (2.3 weight percentage in B conversion) of $B_4C$ particles, 23 μm in average, was added, and in like manner to the embodiments 1 and 2, an extruded member was prepared with a sectional configuration of 48 mm×12 mm. The extruded member thus obtained had such tensile characteristics that withstand force was 62 MPa, tensile strength, 112 MPa, and breaking extension, 39%.

To pure Al molten of 99.7% purity melted in a high-frequency melting furnace were thrown 3 weight percentage of $B_4C$ particles wrapped in aluminum foils, and promptly a well stirring was made, trying to make a composite material, however as the $B_4C$ particles were very hard to get wet, they mostly came up to the molten surface. It therefore was concluded that preparation of an Al—$B_4C$ composite material by a molten stirring method was difficult.

Pure Al raw metal of 99.7 purity and pure B were admixed so that the B content was 2.3 weight percentage, and melted in a high-frequency melting furnace, and cast into billets of a 90 mm diameter to be extruded. Extruded configuration was 48 mm×12 mm. However, as the melting point of B is as very high as 2092° C., it was concluded that in ordinary Al alloy oriented facilities the handling should be difficult (even in use of an Al—B intermediate alloy, the problem should be the same, though the degree might be more or less). An extruded member thus obtained had a low extension of 3.1%, and the use as a structural material was judged to be difficult.

Given the foregoing results, it was confirmed that in order to obtain a material containing a high concentration of B and high of both strength and ductility, preparation of a composite material by a powder method should be optimum, as in the present invention Experiment 5

Next, experiments were made of a composite material composed of the above-noted aluminum composite material and Zr added thereto. In the experiments, a Zr added Al—$B_4C$ particle composite material and an Al—$B_4C$ particle composite material (without Zr addition) were prepared by a powder metallurgical method, and their mechanical properties were compared.

Powder Used

For preparation of Zr added Al—$B_4C$ particle composite material, powder (sample P) of JIS 6N01 components having Zr added in proportion of 0.8 weight percentage and that (sample Q) having this added in proportion of 0.5 weight percentage were prepared by air atomization, and classified to 250 μm or less for use. Wet analysis results of those powder are listed in Table 12. For comparison, wet analysis results of powder (sample R) of JIS 6N01 components also are listed in Table 12. As additive particle to be added to such powder, there was used $B_4C$, 8.7 μm in average particle diameter.

TABLE 12

| Samples Nos. | Si | Mg | Zr | Fe | Mn | Cu | Cr | Zn | Ti | Al |
|---|---|---|---|---|---|---|---|---|---|---|
| P | 0.76 | 0.52 | 0.79 | 0.18 | 0.04 | 0.03 | <0.01 | <0.01 | 0.02 | bal. |
| Q | 0.74 | 0.51 | 0.48 | 0.18 | 0.04 | 0.02 | 0.01 | <0.01 | 0.02 | bal. |
| R | 0.56 | 0.54 | — | 0.08 | 0.04 | <0.01 | <0.01 | <0.01 | <0.01 | bal. |

Preparation of Sample

Figure 9:
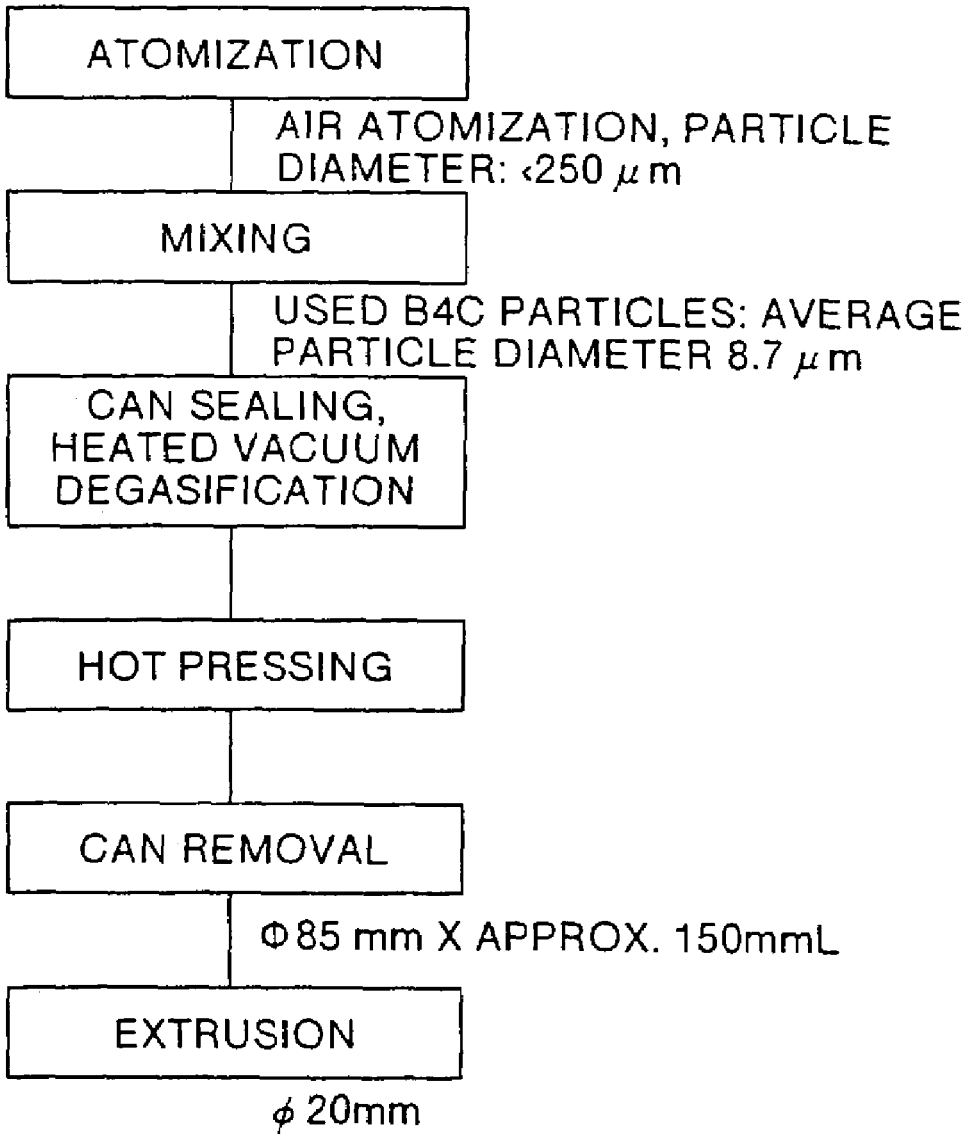
FIG. 9 is a flowchart showing a sample preparation procedure of an Al composite material with added Zr according to the invention.

FIG. 9 shows a procedure for sample preparation.

(1) Billet Preparation

As a first step, using a cross rotary mixer, the above-noted powder and additive particles were mixed for 10–15 minutes. In this experiment, five kinds of samples were prepared, by combinations of matrices and B addition quantities (indicated by a value of calculated weight percentage of B) listed in Table 13.

TABLE 13

| Sample Nos. | Matrix | $B_4C$ addition quantity |
|---|---|---|
| P3 | 6N01 + 0.8Zr | 3 mass % |
| P5 | | 5 mass % |
| Q5 | 6N01 + 0.5Zr | 5 mass % |
| R3 | 6N01 | 3 mass % |
| R5 | | 5 mass % |

As a second step, for a canning, the mixture of matrix powder and additive particles was sealed in a can. Specifications for the can used are as follows.

Material: JIS 6063 (aluminum alloy seamless tube with fully welded bottom plate identical of material)

Diameter: 90 mm

Length: 300 mm

Can thickness: 2 mm

As a third step, a heated vacuum degasification was performed. In this step, canned powder mixture was heated up to 480° C., and inside the can was vacuum-suctioned to 1 Torr or less, which was kept for 2 h. By this degasification, gas components and moisture adsorbed on surfaces of powder in the can were removed.

As a fourth step, a hot pressing was performed. The hot pressing was by a 6000 ton press, at 400–450° C., for 30 seconds. After the hot pressing, the can was removed to obtain a round bar substantially 85 mm in diameter and 150 mm in length, thereby completing preparation of a material to be extruded, that is a billet.

(2) Extrusion

In this step, the billet made by the procedure described was hot extruded, using a 500-ton extruder. Temperature in this case was 510° C.–550° C., and by an extrusion ratio of approx. 25 a round bar 20 mm in diameter was formed.

Evaluation

Samples P3, P5, Q5, R3, and R5 prepared by the steps described were evaluated in the following manner.

(1) Microscopic Structure Observation

This was made for all samples A to L, in a central part of the extruded material, to a T section (perpendicular to an extruded direction), without etching as a preceding process. By the results, it was confirmed that any sample had a structure in which $B_4C$ particles were uniformly fine dispersed in the matrix.

(2) Tensile Test

This tensile test was performed under two temperature conditions, at a room temperature and at 200° C. after a 100 h holding at 200° C. For samples P3, Q5 and R5, their tensile tests were made also under such temperature conditions as at 180° C. after a 100 h holding at 180° C. and at 200° C. after a 100 h holding at 350° C. In any tensile test, there was employed a round bar specimen 8 mm in diameter at a parallel part, and its inter-mark distance for the test was set to 30 mm. Results of this test are listed in Table 14.

TABLE 14

| | | | Room temperature | | | 180° C. × 100 h holding → 180° C. tensile test | | | 200° C. × 100 h holding → 200° C. tensile test | | | 200° C. × 100 h holding → 200° C. tensile test | | |
|---|---|---|---|---|---|---|---|---|---|---|---|---|---|---|
| | Zr | $B_4C$ | 0.2% withstand force (MPa) | Tensile strength (Mpa) | Breaking extension (%) | 0.2% withstand force (MPa) | Tensile strength (Mpa) | Breaking extension (%) | 0.2% withstand force (MPa) | Tensile strength (Mpa) | Breaking extension (%) | 0.2% withstand force (MPa) | Tensile strength (Mpa) | Breaking extension (%) |
| P3 | 0.8 | 3 | 143 | 209 | 23.7 | 110 | 133 | 34.7 | 92 | 112 | 35.0 | 94 | 115 | 37.3 |
| P5 | 0.8 | 5 | 151 | 215 | 25.0 | | | | 99 | 116 | 39.0 | | | |
| Q5 | 0.5 | 5 | 135 | 201 | 23.7 | 101 | 124 | 41.7 | 90 | 110 | 33.7 | 91 | 112 | 41.7 |
| R3 | 0 | 3 | 81 | 157 | 30.3 | | | | 62 | 78 | 48.7 | | | |
| R5 | 0 | 5 | 79 | 157 | 31.7 | 72 | 93 | 46.7 | 62 | 80 | 46.7 | 52 | 73 | 53.7 |

Among experimental results of table 14, results on 0.2% withstand force are as follows. At room temperature, those (samples P3, P5 and Q5) having added Zr are within a range of 135 MPa–151 MPa, and those (samples R3 and R5) having no Zr added are within a range of 79 MPa–81 MPa. At 180° C. after a 100 h holding at 180° C., those (samples P3 and Q5) having added Zr are within a range of 101 MPa–110 MPa, and that (sample R5) having no Zr added is 72 MPa. At 200° C. after a 100 h holding at 200° C., those (samples P3, P5 and Q5) having added Zr are within a range of 90 MPa–99 MPa, and those (samples R3 and R5) having no Zr added are 62 MPa. At 200° C. after a 100 h holding at 350%, those (samples P3 and Q5) having added Zr are within a range of 91 MPa–94 MPa, and that (sample R5) having no Zr added is 52 MPa.

In any case, those having added Zr are better in 0.2% withstand force, fully meeting the required characteristics for use to a basket.

Results on tensile strength are as follows. At room temperature, those (samples P3, P5 and Q5) having added Zr are within a range of 201 MPa–215 MPa, and those (samples R3 and R5) having no Zr added are 157 MPa. At 180° C. after a 100 h holding at 180° C., those (samples P3 and Q5) having added Zr are within a range of 124 MPa–133 MPa, and that (sample R5) having no Zr added is 93 MPa. At 200°

C. after a 100 h holding at 200° C., those (samples P3, P5 and Q5) having added Zr are within a range of 110 MPa–116 MPa, and those (samples R3 and R5) having no Zr added are within a range of 78 MPa–80 MPa. At 200° C. after a 100 h holding at 350° C., those (samples P3 and Q5) having added Zr are within a range of 112 MPa–115 MPa, and that (sample R5) having no Zr added is 73 MPa.

In any case, those having added Zr are better in tensile strength, fully meeting the required characteristics for use to a basket.

Results on breaking extension are as follows. At room temperature, those (samples P3, P5 and Q5) having added Zr are within a range of 23.7%–25.0%, and those (samples R3 and R5) having no Zr added are within a range of 30.3%–31.7%. At 180° C. after a 100 h holding at 180° C., those (samples P3 and Q5) having added Zr are within a range of 34.7%–41.7%, and that (sample R5) having no Zr added is 46.7%. At 200° C. after a 100 h holding at 200° C., those (samples P3, P5 and Q5) having added Zr are within a range of 33.7%–39.0%, and those (samples R3 and R5) having no Zr added are within a range of 46.7%–48.7%. At 200° C. after a 100 h holding at 350° C., those (samples P3 and Q5) having added Zr are within a range of 37.3%–41.7%, and that (sample RS) having no Zr added is 53.7%.

In any temperature condition, those having added Zr are better in breaking extension than Boral's extension 1.2% (see Table 5).

Figure 10:
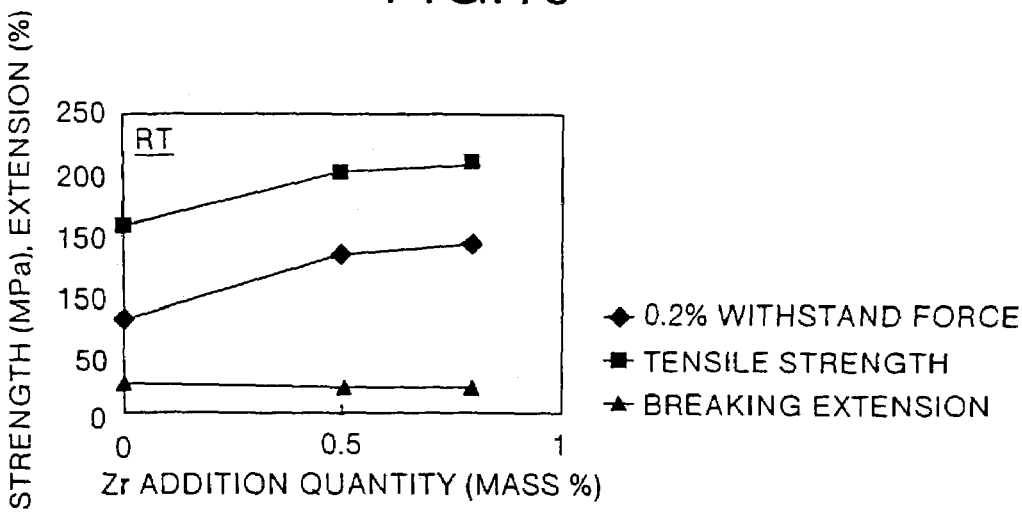
FIG. 10 is a graph of a mechanical property of an Al composite material according to the invention, showing an effect of addition quantity of Zr at a room temperature.
Figure 11:
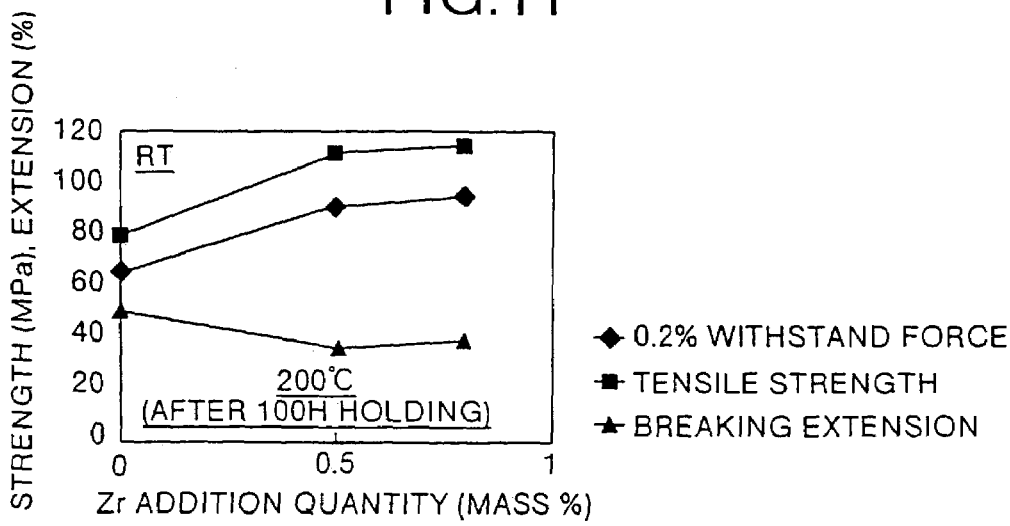
FIG. 11 is a graph of a mechanical property of an Al composite material according to the invention, showing an effect of addition quantity of Zr at 200° C. after a 100 h holding at 200° C.

FIG. 10 and FIG. 11 are graphs showing an effect of Zr addition quantity (weight percentage) to tensile characteristic. FIG. 10 plots values (see Table 14) of 0.2% withstand force (MPa), tensile strength (MPa), and breaking extension (%) respectively of samples P3, Q5 and R3 under the temperature condition at room temperature. It is seen from this graph that, as the Zr addition quantity increases, 0.2% withstand force (MPa) and tensile strength (MPa) increase, while between that (sample Q5) of which the Zr addition quantity is 0.5 weight percentage and that (sample P3) of which the Zr addition quantity is 0.8 weight percentage, the difference is small. The breaking extension (%) is rendered small by addition of Zr, while there is no difference between Zr addition quantity of 0.5 weight percentage and that of 0.8 weight percentage.

FIG. 11 plots values (see Table 14) of 0.2% withstand force (MPa), tensile strength (MPa), and breaking extension (%) respectively of samples P3, Q5 and R3 under the temperature condition at 200° C. after a 100 h holding at 200° C. It is seen from this graph that, as the Zr addition quantity increases, 0.2% withstand force (MPa) and tensile strength (MPa) increase, like FIG. 10. Breaking extension (%) becomes small by addition of Zr, while that of Zr addition quantity of 0.8 weight percentage is greater than that of 0.5 weight percentage. It however is seen that between that (sample Q5) of which the Zr addition quantity is 0.5 weight percentage and that (sample P3) of which the Zr addition quantity is 0.8 weight percentage, the difference is small.

(3) Young's Modulus and Poisson's Ratio Measurements

Figure 12:
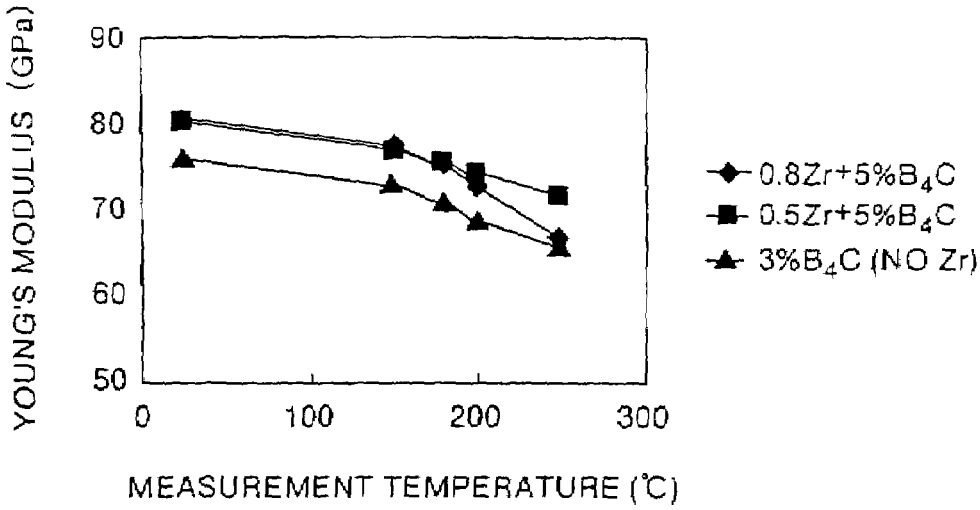
FIG. 12 is a graph showing results of measurement of Young's modulus of an Al composite material according to the invention, at various temperatures.

Young's modulus and Poisson's ratio were measured of samples P5, Q5, and R3, by using a proper vibration resonance method. Specimens for the measurement were of a configuration with a 10 mm width, a 60 mm length, and a 2 mm thickness, and sampled from samples held at 200° C. for 100 hours. Measurement temperature was set to a room temperature (25° C.), 150° C., 180° C., 200° C., and 250° C. Results of this measurement are listed in Table 15, and measurement results of Young's modulus are shown in FIG. 12. In Table 15, Poisson's ratios are parenthesized.

TABLE 15

| | | | Young's modulus (GPa) [Poisson's ratio] | | | | |
|---|---|---|---|---|---|---|---|
| | Zr | $B_4C$ | 25° C. | 150° C. | 180° C. | 200° C. | 250° C. |
| P5 | 0.8 | 5 | 80.3 [0.29] | 77.8 [0.29] | 75.0 [0.29] | 72.6 [0.30] | 66.6 [0.30] |
| Q5 | 0.5 | 5 | 80.5 [0.27] | 77.0 [0.27] | 75.5 [0.28] | 74.3 [0.29] | 71.5 [0.29] |
| R3 | 0 | 3 | 76.1 [0.29] | 73 [0.29] | 70.8 [0.30] | 68.9 [0.30] | 65.7 [0.30] |

It is seen from Table 15 and a graph of FIG. 12 that, at any temperature, those (samples P5 and Q5) having added Zr are higher in value of Young's modulus than that (sample R3) having no Zr added. However, in a temperature region up to 180° C., there is almost no difference between that (sample Q5) of which the Zr addition quantity is 0.5 weight percentage and that (sample P5) of which the Zr addition quantity is 0.8 weight percentage, while in a higher temperature region, Young's modulus of that (sample P5) of 0.8 weight percentage is reduced. As in Table 15, Poisson's ratio is substantially the same, irrespective of presence or absence of added Zr.

(4) Measurement of Electrical Conductivity

For samples P3, P5, Q5, R3, and R5, as a simple evaluation method of heat conductivity, electrical conductivity was measured at a T section (perpendicular to the extruded direction) in a central part of the extruded material, by using an eddy current type electrical conductivity meter. For each sample, its electrical conductivity was measured at a normal temperature on a state as it was left extruded, and at a normal temperature after a 100 h holding at 200° C. Results of this measurement are listed in Table 16, and shown in graphs in FIG. 13 and FIG. 14.

TABLE 16

| | | | Electrical conductivity (IACS %) | |
|---|---|---|---|---|
| | Zr | $B_4C$ | In extruded state | After 200° C. × 100 h holding |
| P3 | 0.8 | 3 | 49.2 | 51.6 |
| P5 | 0.8 | 5 | 48.0 | 49.0 |
| Q5 | 0.5 | 5 | 47.5 | 48.2 |
| R3 | 0 | 3 | 50.9 | 53.0 |
| R5 | 0 | 5 | 48.8 | 50.7 |

Figure 13:
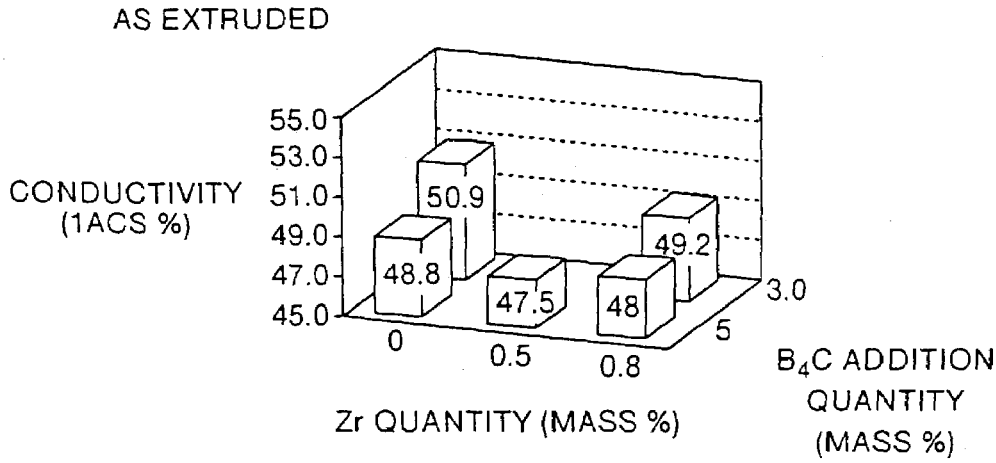
FIG. 13 is a graph of measurement results of electrical conductivity of an Al composite material according to the invention, showing effects of B and Zr addition quantity, for samples left as extruded.
Figure 14:
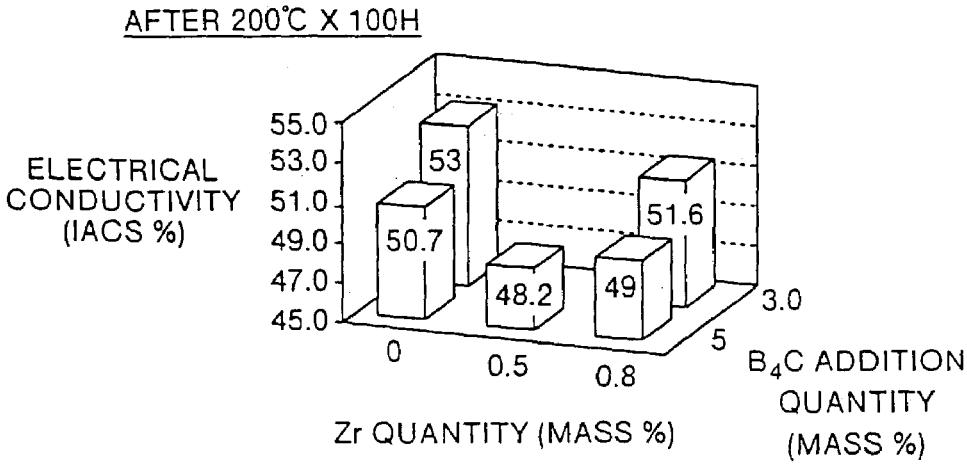
FIG. 14 is a graph of measurement results of electrical conductivity of an Al composite material according to the invention, showing effects of B and Zr addition quantity, for samples held at 200° C. for 100 h.

It is seen from Table 16, graphs of FIG. 13 and FIG. 14 that the electrical conductivity is within a range of 47.5 IACS %–51.6 IACS % for those (samples P3, P5 and Q5) having added Zr, and within a range of 48.8 IACS %–53.0 IACS % for those (samples R3 and R5) having no Zr added. It also is seen that the electrical conductivity is lowered by addition of B or Zr, whether in an extruded state or after 100 h holding at 200° C. In particular, the effect of added B is greater than that of added Zr.

Figure 15:
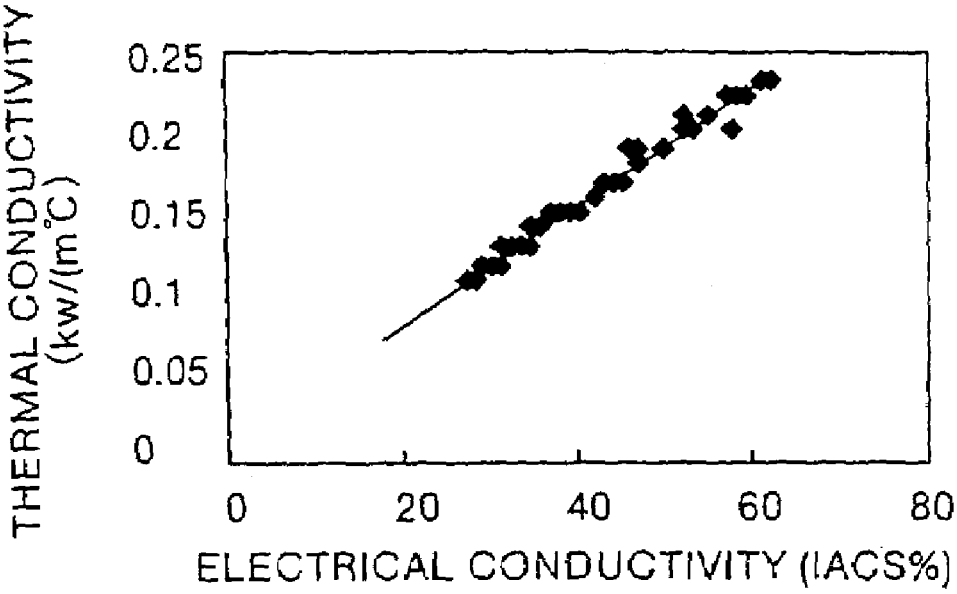
FIG. 15 is a graph showing relationships between electrical conductivity and thermal conductivity, for various Al materials.
Figure 16:
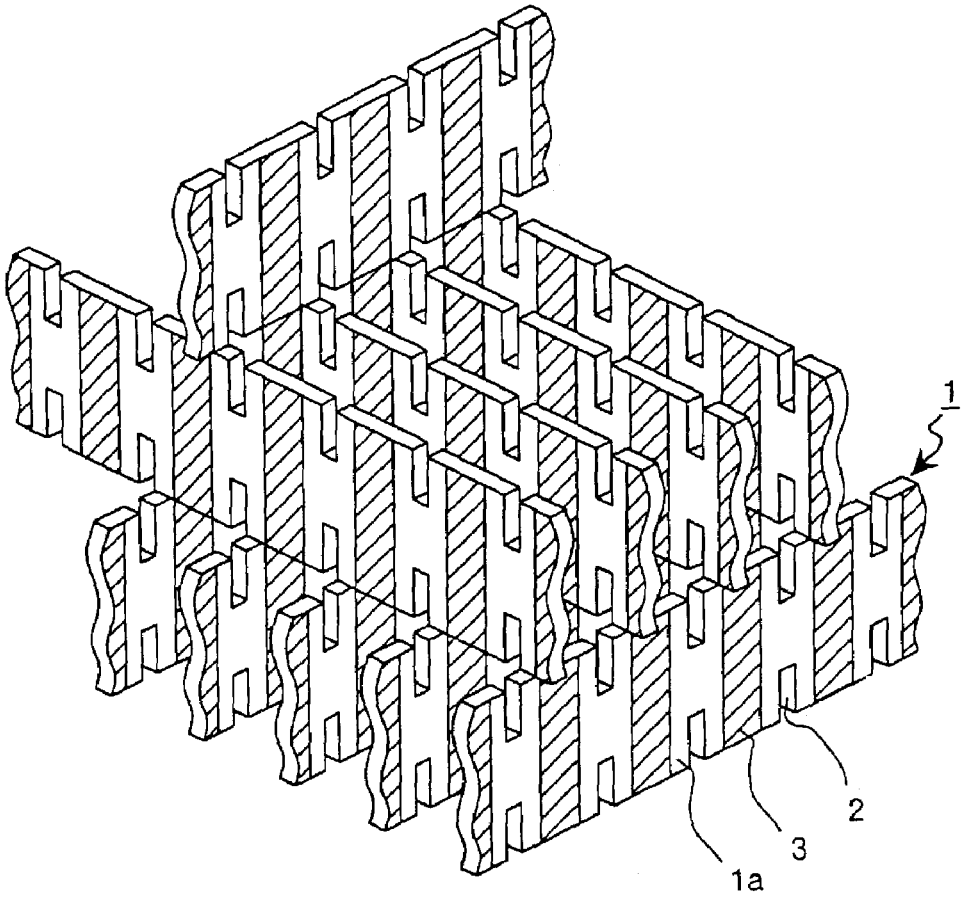
FIG. 16 is an exploded partial perspective view showing a conventional basket structure.

FIG. 15 is a graph showing a relationship between thermal conductivity and electrical conductivity of various Al materials. As in this graph and from results in Table 16, the thermal conductivity is within a range of 0.18 kW/m·° C.–0.19 kW/m·° C. for those (samples P3, P5 and Q5) having added Zr, and within a range of 0.19 kW/m·° C.–0.20 kW/m·° C. for those (samples R3 and R5) having no Zr added. Therefore, in respect of thermal conductivity, it can be said that there is substantially no difference, whether Zr is added or not. That is, thermal conductivity will not be lowered by addition of Zr.

Like this, the above-noted Zr added aluminum composite material allows for a high B quantity to be added, and is excellent of neutron absorption ability, in addition to that it is excellent also in tensile strength and extension, and has a high workability. Therefore, it is preferably applicable as a structural material for constructing a basket for accommodating used nuclear fuel assemblies and a cask provided with the basket.

An aluminum composite material and a manufacturing method therefor according to the present invention have the following effects.

An aluminum composite material manufactured by using a powder metallurgical method including adding, in Al or Al alloy powder, B or B compound powder having a neutron absorption ability, and subsequently subjecting to a sintering under pressure, allows addition of a greater amount (1.5–9 weight percentage) of B or B compound than by conventional dissolution method. Therefore, by an increased addition quantity of B, the absorption ability can be improved, in particular for high speed neutrons.

Moreover, the aluminum composite material has additive elements, such as Zr and Ti, added for giving a high strength nature, and not only is high of neutron absorption ability, but also is excellent in strength and ductility to be balanced. Therefore, there is implemented an aluminum composite material preferable as a structural member.

Further, by using an aluminum composite material according to the present invention as a structural material of a basket, the basket itself can have a high neutron absorption ability, and can be manufactured with a reduced number of man-hours, permitting a reduced cost. And, by provision of a basket excellent of neutron absorption and capable of manufacture at an inexpensive cost, a cask is allowed to have an improved performance and reliability, in addition to that it can be manufactured inexpensively.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An aluminum composite material, comprising a matrix comprising an Al—Mg—Si aluminum alloy containing at least one selected from the group consisting of Ti and Zr; and particles comprising $B_4C$ or $B_2O_3$ in the matrix, wherein the composite material comprises B in an amount ranging from 1.5 weight percentage to 9 weight percentage.

2. The aluminum composite material according to claim 1, wherein the composite material comprises Ti in an amount ranging from 0.2 weight percentage to 4.0 weight percentage.

3. A basket having a latticed cross-section for accommodating an individual used nuclear fuel assembly in a predetermined position in a cask, comprising the aluminum composite material as claimed in claim 1.

4. The basket according to claim 3, wherein the latticed cross-section comprises extruded tube members comprising the aluminum composite material bound together.

5. The basket according to claim 4, wherein the tube members are bound together by brazing.

6. The aluminum composite material according to claim 1, wherein the Al—Mg—Si aluminum alloy is selected from the group consisting of a JIS 6xxx series alloy.

7. The aluminum composite material according to claim 1, wherein the Al—Mg—Si aluminum alloy is selected from the group consisting of a JIS 6000 series alloy.

8. The aluminum composite material according to claim 1, wherein the aluminum composite material is produced by a process in which the composite material is sintered under pressure by at least one process selected from the group consisting of hot extrusion, hot milling, hot static water pressure pressing, hot pressing, and a combination thereof.

9. The aluminum composite material according to claim 1, wherein the aluminum composite material is produced by a process in which the composite material is sintered under pressure at a temperature of 350° C. to 550° C. for 5 to 10 minutes.

10. The aluminum composite material according to claim 8, wherein prior to sintering the aluminum composite material under pressure, the aluminum composite material is subjected to degasification.

11. The aluminum composite material according to claim 8, wherein aluminum composite material is produced by a process in which the composite material is naturally aged without a thermal process in accordance with a JIS Ti process.

12. The aluminum composite material according to claim 1, wherein the composite material is obtained by a process comprising sintering under pressure and subsequently naturally aging without a thermal process a mixture comprising Al—Mg—Si alloy powder, $B_4C$ powder or $B_2O_3$ powder, and at least one of Ti powder and Zr powder.

13. The aluminum composite material according to claim 1, wherein the composite material comprises B in an amount ranging from 4.7 weight percentage to 9 weight percentage.

14. An aluminum composite material, comprising an Al—Mg—Si aluminum alloy;

B or B compound in an amount ranging from 4.7 weight percentage to 9 weight percentage, in terms of boron; and Ti in an amount ranging from 0.2 weight percentage to 4.0 weight percentage or Zr in an amount ranging from 0.2 weight percentage to 2.0 weight percentage.

15. The aluminum composite material according to claim 14, wherein the composite material is obtained by a process comprising sintering under pressure and subsequently naturally aging without a thermal process a mixture comprising Al—Mg—Si alloy powder, B powder or B compound powder, and Ti powder and or Zr powder.

16. A cask comprising:

a basket having a latticed cross-section for accommodating an individual used nuclear fuel assembly in a predetermined position in the cask, comprising:

the aluminum composite material as claimed in claim 1;

a hollow cask body comprising:

a barrel body for receiving and withstanding a pressure, and a neutron shielding part surrounding an outer portion of the barrel body and configured to accommodate the basket therein; and a lid configured to be attached to and removed from an opening provided in the cask body for the used nuclear fuel assembly to be let therethrough for entry and removal.

17. The cask according to claim 16, wherein the latticed cross-section comprises extruded tube members comprising the aluminum composite material bound together.

18. The cask according to claim 17, wherein the tube members are bound together by brazing.

* * * * *